United States Patent [19]

Eickmann

[11] Patent Number: 4,569,630

[45] Date of Patent: Feb. 11, 1986

[54] AXIAL PISTON MACHINE HAVING A CONTROL FLOW FLUID LINE PASSING THROUGH A MEDIAL SHAFT PORTION

[76] Inventor: Karl Eickmann, 2420 Isshiki, Hayama-machi, Kanagawa-Ken, Japan

[21] Appl. No.: 387,567

[22] Filed: Jun. 11, 1982

Related U.S. Application Data

[63] Continuation-in-part of Ser. No. 954,555, Oct. 25, 1978, Pat. No. 4,358,073, and a continuation-in-part of Ser. No. 122,914, Feb. 19, 1980, abandoned, and a continuation-in-part of Ser. No. 224,769, Jan. 13, 1981, abandoned, and a continuation-in-part of Ser. No. 282,990, Jul. 14, 1981.

[51] Int. Cl.[4] ..... B64C 11/38; F01B 13/04

[52] U.S. Cl. ..... 416/157 R; 416/158; 416/171; 91/499

[58] Field of Search ..... 91/484, 485, 488, 499, 91/472; 416/157 R, 158, 171; 244/17.25

[56] References Cited

U.S. PATENT DOCUMENTS

| | | | |
|---|---|---|---|
| 2,523,053 | 9/1950 | Obrist | 416/157 X |
| 3,188,972 | 6/1965 | Thoma | 91/485 |
| 3,207,226 | 9/1965 | Caldwell | 416/157 |

FOREIGN PATENT DOCUMENTS

| | | | |
|---|---|---|---|
| 2924135 | 1/1980 | Fed. Rep. of Germany | 91/499 |
| 883348 | 3/1943 | France | 91/485 |
| 54-72504 | 11/1979 | Japan | 91/499 |
| 56-38583 | 4/1981 | Japan | 91/499 |
| 70532 | 8/1952 | Netherlands | 416/157 |
| 756073 | 8/1980 | U.S.S.R. | 91/499 |

*Primary Examiner*—William L. Freeh
*Assistant Examiner*—Paul F. Neils

[57] ABSTRACT

In hydrostatic pumps, motors and transmissions; faces, which slide and seal along adjacent faces, commonly have recesses for hydrostatic lubrication or for control of flow through ports.

The invention provides additional arrangements on such faces for the provision of additional functions, for example, for the control of hydrodynamic flow into spaces between faces, the control of an additional control flow through the faces and the sealing therof or it provides recesses or seal inserts of specific locations or configurations for the improvement of the efficiency of the faces or for assurance of additional actions by the faces.

13 Claims, 29 Drawing Figures

Fig. 23

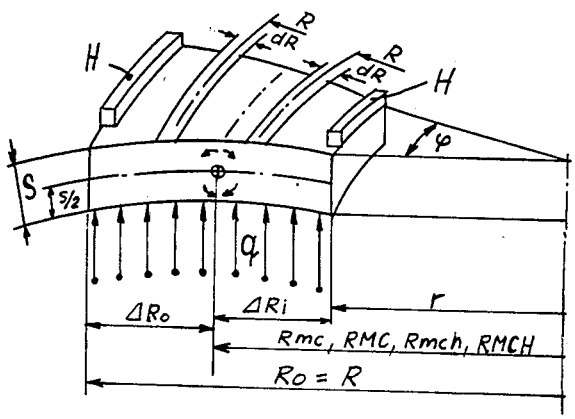

$$dMd = q\,B\,\Delta R\,d\Delta R \qquad (1)$$

$$B = \frac{\varphi\pi}{180}(r+\Delta R_i) \qquad (2)$$

$$\text{OR} \qquad B = \frac{\varphi\pi}{180}(R_o - \Delta R_o)$$

$$dMdi = q\left(\frac{\varphi\pi}{180}\right)(r+\Delta R)\,\Delta R\,d\Delta R \qquad (3)$$

$$Md = q\int\left(\frac{\varphi\pi}{180}\right)[f(\Delta R)]\,d\Delta R \qquad (4)$$

$$Mdi = q\left(\frac{\varphi\pi}{180}\right)\left[\frac{r}{2}(\Delta R_i)^2 + \frac{1}{3}(\Delta R_i)^3\right] \quad (5) \qquad Mdo = q\left(\frac{\varphi\pi}{180}\right)\left[\frac{R}{2}(\Delta R_o)^2 - \frac{1}{3}(\Delta R_o)^3\right] \quad (6)$$

$$\sigma_B = \frac{M}{J}(S/2) \quad (7) \qquad J = \left(\frac{\varphi\pi}{180}\right)RMC\cdot S^3/12 \quad (8) \qquad M = Md(\Delta R)/(S/2) \quad (9)$$

$$\sigma_{Bi} = q\left(\frac{\varphi\pi}{180}\right)\left[\frac{r}{2}(\Delta R_i)^2 + \frac{1}{3}(\Delta R_i)^3\right]\left[\Delta R_i/(S/2)\right](S/2)\Big/\left(\frac{\varphi\pi}{180}\right)S^3/12 \quad (10)$$

$$\sigma_{Bo} = q\left(\frac{\varphi\pi}{180}\right)\left[\frac{R_o}{2}(\Delta R_o)^2 - \frac{1}{3}(\Delta R_o)^3\right]\left[\Delta R_o/(S/2)\right](S/2)\Big/\left(\frac{\varphi\pi}{180}\right)S^3/12 \quad (11)$$

$$\sigma_{Bi} = 12q\left[\frac{r}{2}(RCM-r)^2 + \frac{1}{3}(RCM-r)^3\right](RCM-r)/RCM\cdot S^3 \qquad (12)$$

$$\sigma_{Bo} = 12q\left[\frac{R_o}{2}(R_o-RCM)^2 - \frac{1}{3}(R_o-RCM)^3\right](R_o-RCM)/RCM\cdot S^3 \qquad (13)$$

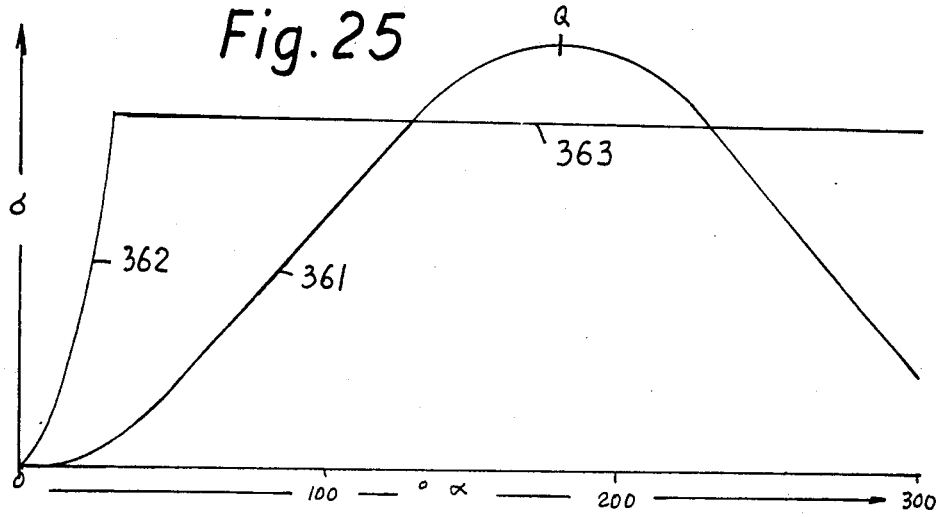

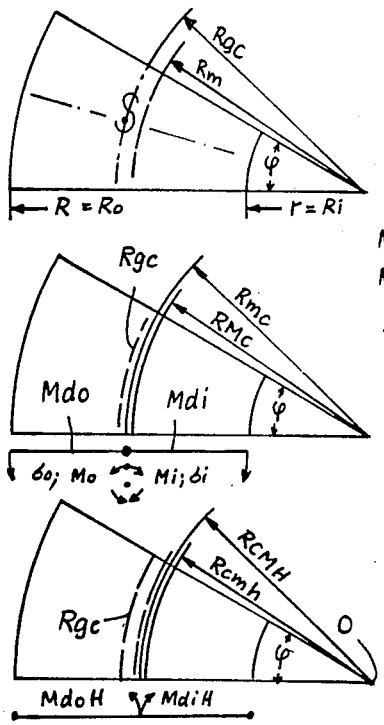

Fig. 24

$Rm = (R+r)/2$ $S$ = Centroid $Rgc$ = RADIUS FOR CENTROID $Rgc = (2/3)(R^3-r^3)/(R^2-r^2)$ $Rmc$ = EQUAL MOMENTS OF FLUID PRESSURE.

$Mdo = Mdi = \frac{r}{2}(Rmc-r)^2+\frac{1}{3}(Rmc-r)^3 = \frac{R}{2}(R-Rmc)^2-\frac{1}{3}(R\ Rmc)^3$ $Mod = Mid = \frac{r}{2}(RMc-r)^2+\frac{1}{3}(RMc-r)^3 = \frac{R}{2}(R-RMc)^2-\frac{1}{3}(R-RMc)^3$ = MOMENTS AROUND $Rmc$ AND $RMc$ RmcH AND RMCH GIVE EQUAL MOMENTS OF AREAS AND INNER STRESS AROUND HOLDERS "H"

$\frac{Rmc}{2}(Rmc-r)^3+\frac{Rmc}{3r}(Rmc-r)^4 = \frac{Rmc}{2}(R-Rmc)^3-\frac{Rmc}{3R}(R-Rmc)^4$ $\frac{RMc}{2}(RMc-r)^3+\frac{RMc}{3r}(RMc-r)^4 = \frac{RMc}{2}(R-RMc)^3-\frac{RMc}{3R}(R-RMc)^4.$

MOMENT AROUND THE CENTRE AXIS "O":

$dMdc = q\,B\,R\,dR$; $B=(\varphi\pi/180)R$ $dMdc = q(\varphi\pi/180)RRdR.$ $Mdc = q\frac{\varphi\pi}{180}\int R^2dR$; $Mdc = q\frac{\varphi\pi}{540}(R^3-r^3)$ or: $Mdc = [Rgc\,(R^2-r^2)\,\varphi\pi/360]\,q$

AXIAL PISTON MACHINE HAVING A CONTROL FLOW FLUID LINE PASSING THROUGH A MEDIAL SHAFT PORTION

REFERENCE TO RELATED APPLICATION

This application is a continuation in part application of my co-pending patent application Ser. No. 954,555 which was filed on Oct. 25, 1978, now U.S. Pat. No. 4,358,073; issued Nov. 9, 1982; benefit of which is claimed here with.

This application is also a continuation in part application of my now abandoned application Ser. No. 122,914 which was filed on Feb. 19, 1980. This application is also a continuation in part application of my co-pending patent applications Ser. No. 224,769, now abandoned, filed on Jan. 13, 1981 and Ser. No. 282,990, filed on July 14, 1981. Benefits of the above mentioned applications are claimed for the present continuation in part patent application.

BACKGROUND OF THE INVENTION (a) Field of the Invention:

The invention relates to improvements in hydrostatic pumps, motors, transmission and parts, especially faces, thereof. They are applicable partially on piston shoes of radial piston fluid flow facilitating devices, in or on control bodies of radial chamber or radial flow facilitating pumps, motors, transmissions or to axial piston type fluid flow facilitating machines, such, motors, or transmissions.

(b) Description of the Prior Art:

In the prior art of fluid flow facilitating devices, such as pumps, motors, transmissions of radial chamber or axial piston-machines, the decisive faces, like seal faces or control faces serve for example the control of flow of fluid, the hydrostatic pressure balance, or the sealing of relatively to each other moving faces.

However, the faces of the former art commonly serve only a maximum of two functions, but seldom for more functions.

Until now no faces of the former art have come to applicant's knowledge which would provide, assist, or assure an additional function, which was not common in the machines of the former art.

The former art appears, therefore, to be limited to the service of the faces for single or double functions.

SUMMARY OF THE INVENTION

The aim and object of the invention is, to provide arrangements on the generally known faces of fluid flow facilitating devices, wherein the mentioned arrangements are of such nature, that they improve the functions of earlier faces to a better reliability, to a higher efficiency or that they provide new functions to the known mentioned faces, whereby the devices obtain better applicabilities for additional new functions or actions.

The details of the objects of the invention, as well as the major arrangements to respective known devices or faces therein, may be defined, for example, as follows:

(1) An arrangement in a fluid flow facilitating device with provision of a commonly applied primary first control means and at least one rotor, wherein the arrangement provides a second control means for the control of a controllable matter associated to the device.

(2) The arrangement of (1), wherein said rotor is located in a fluid flow facilitating machine and wherein said second control means extends through said rotor and a control means of said machine.

(3) An Arrangement provided on slide faces of piston shoes in radial piston fluid flow facilitating devices, such as pumps, motors, transmissions, wherein said slide faces are the outer faces of the piston shoes and are sliding along the guide face(s) of the piston stroke actuator of the device; said slide faces have fluid pressure pockets which form together with their surrounding sealing lands hydrostatic bearings, wherein said slide faces have extensions in the direction of their movement and separating recesses between said extensions and said sealing lands, and, wherein said extensions include two portions, a first and a second portion, while the first portion has a radius substantially equal to the radius of the respective inner face of the respective piston stroke actuator's guide face(s) and said second portion has a very slightly smaller radius than the said first portion has, in order to form a clearance of the form of a very small inclination between the adjacent face-portions in order to permit the entrance of fluid under the movement of the faces relatively to each other and in order to form thereby hydrodynamic pressure flields of a desired force and extent between said adjacent portions of said faces.

(4) An arrangement, wherein a rotor has cylinders and therein reciprocating pistons which carry piston shoes for sliding along a guide face of a piston stroke actuator member, wherein said piston shoes have outer faces of a radius substantially equal to the radius of said guide face and wherein inclined face portions are provided on said piston shoes which are inclined relatively to said guide face in order to form hydrodynamic pressure fields between said faces when one of said faces moves relatively to the other.

(5) The Arrangement of (1), provided on on a holding face of an axial piston type fluid flow facilitating device, such as a pump, motor or transmission of the axial piston type, wherein said holding face is commonly utilized to hold the spherical head of a member of the device or to bear the member of the device, wherein the arrangement consists of a passage through said holding face in combination with a passage extension into a cylinder arranged to the shaft of the device, wherein said cylinder carries axially movable therein a piston which is subjected from one end to a flexible force and from the other end to fluid pressure passed through said passage through said holding face into said cylinder, wherein said piston includes transfer means to transfer its movement to controlable members, and, wherein thereby said controlable members are controlled by said fluid pressure which passes through said arrangement of said passage through said holding face.

(6) The arrangement of (5), wherein said primary first control means is the control mirror between the stationary control face and the rotor of the said axial piston type device, said passage of said holding face is said second control means of said arrangement; and wherein said holding face is provided in the shaft of the device and holds the head of a medial element of said rotor, and, wherein said passage extends through said medial element, said rotor and said control mirror sealed against loss of pressure and fluid into and through a stationary portion of the housing of said axial piston device to form a control port for the reception of control fluid for the control of said member.

(7) The arrangement of (6), wherein a first communication passes fluid to a respective fluid pressure pocket of a hydrostatic bearing adjacent to said holding face, said passage and said communication extend through said rotor and said element towards said holding face, said holding face seals said fluid pressure pocket and separates the fluids which pass through said passage and said communication from each other and, wherein a recess is provided in said head of said element to communicate with said passage.

(8) The arrangement of (1), provided on a substantial cylindrical control body arranged in the hub of a rotor, wherein said control body has an outer face substantially fitting on the inner face of said hub of said rotor when said rotor revolves around said control body, wherein fluid is passed through said control body into ports in said control body to control the flow of fluid into and out of working chambers in said rotor, wherein a narrow clearance between said faces provides the usual sealing between said faces, but the pressure in said flow is of such a hight that leakagage can escape in at least small amounts through said clearance and said control body might be forced into eccentric location within said small clearance, and, wherein said arrangement is provided to said faces.

(9) The arrangement of (8), wherein said control body has two halves of symmetrical outer faces, whereof each is exactly of a radius equal to the radius of the inner face of said hub of said rotor, recesses are provided between said faces to limit the extent of pressure fluid around a control port of said control ports and to lead entereing fluid away from said recesses, and, wherein thrust means are provided in said rotor to press said rotor and said control body together in their high pressure area, whereby one of said halves of said outer faces is pressed close against said inner face of said rotor and said inner face and that halves of that halves of said outer faces seal along each other.

(10) The arrangement of (9), wherein one of said halves of said outer faces extends more than 180 degrees about said control body to close at least also a portion of passages to said working chambers in said rotor at the areas of the control archs between the high pressure and low pressure areas of the device.

(11) The arrangement of (8), wherein seal inserts are provided in respective recesses in a respective portion of said control body to prevent escape of leakage or to prevent entering of undesired air through the clearance in axial direction.

(12) The arrangement of (8), wherein said control body has a longitudinal imaginary central axis and a space is provided through said control body in a direction normal to said central axis, whereby said bore extends around a second axis which is normal to said central axis, wherein at least one radially moveable thrust member is provided in said space and subjected to pressure in fluid on its bottom in said space, whereby said thrust member is pressed radially outwardly against said inner face of said rotor, wherein said thrust member has an outer face of a configuration partially complementary to said inner face of said rotor, which is pressed against a portion of said inner face of said rotor to seal there along, and, wherein said thrust member communicates with at least one of said passages in said control body and contains at least one of said control ports communicated through said thrust member, with said at least one passage, whereby said thrust member takes over the control of flow of fluid into or out of respective rotor passages to working chambers of said rotor under tight sealing of said control port and under pressure in said space in said control body while its location within said device is defined and maintained by said space in said control body,

(13) The arrangement of (12), wherein said space contains two oppositionally directed thrust members of the means of said at least one thrust member.

(14) The arrangement of (13), wherein said at least one thrust member is extended in a limited extent in both axial directions of said control body and contains a pair of fluid pressure balancing pockets with each one of said pockets arranged in opposite direction of said control port relatively to the other pocket of said pair of pockets, wherein fluid is passed through respective communication means into said pockets and said fluid pressure pockets and their surrounding sealing lands are incorporated into the balancing system to operate the control of flow of fluid with smallest leackage and a smallest possible friction.

(12) The arrangement of (1), wherein the means of said device are incorporated into a flying machine and are used to control the flying style of said flying machine and/or to control the propeller pitches of the flying machine, to operate the compressors of said flying machine, to change said flying machine from vertical to horizontal flight, from helicopter-style flying to gyrocopter-style flying or to winged aircraft style flying and/or to control or drive the propeller(s) of said flying machine.

(13) The arrangement of (1), wherein said second control means is associated to a fluid flow facilitating apparatus, extending from one end of said apparatus through a control means in said apparatus and through a rotor in said apparatus to control a moveable member close to the other end of said apparatus.

(14) The arrangement of (1), wherein means are associated, which are shown in one or more of the figures of the drawing or which are described in the specification.

(15) The novel arrangement of a plural cylinder device, wherein a first and second piston are working in unison to form a transmission, and, wherein a third pump may be driven by said second piston to pump a corrosion-active fluid if desired even under extremely high pressure.

BRIEF DESCRIPTION OF THE DRAWINGS

FIG. 23 is a schematic including mathematical formulas.

FIG. 24 is also a schematic, explainig mathematical values.

FIG. 25 is a schematic diagram explaining values of a device of the invention, wherefore the device is shown in FIG. 21.

DESCRIPTION OF THE PREFERRED EMBODIMENTS

In radial piston type fluid machines, like compressors, pumps or motors it was often assumed, that an hydrodynamic action would develop between the outer faces of the piston shoes and the inner guide face of the piston stroke actuator ring means.

Some patents and designs, for example, the West German Pat. No. 2,307,997, have assumed, that such action would appear automatically by the movement of the faces which are parallel to each other.

The truth however is, according to this present invention, that between parallel faces no hydrodynamic action can take place and therefrom follows, that no hydrodynamic bearing action appears between the common piston shoe outer faces and the guide faces of the actuator means. This truth comes from the fact, that the mentioned faces have substantially equal radii. Consequently, when the said faces slide along each other, the faces are parallel to each other. Between parallel faces however no hydrodynamic fluid pressure can develop, because for the development of a hydrodynamic pressure between relatively to each other moving faces an inclination must be present which narrows the distance between the faces contrary to the direction of movement.

Figure 11:
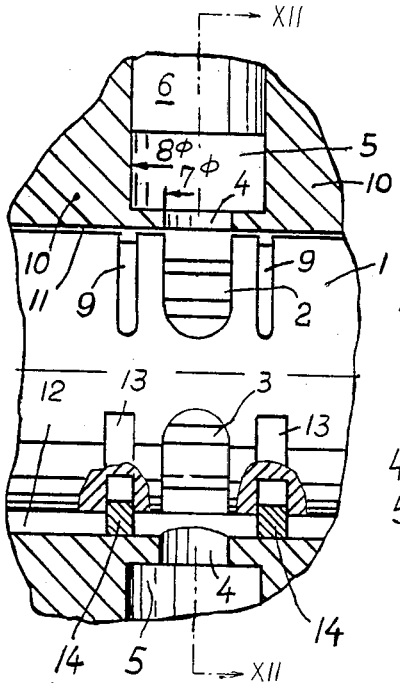
FIG. 11 is a partial view through a radial piston device.

The requirement of such relative inclination between relatively to each other moving faces or parts thereof is already recognized by the tapered depressions 66 of FIG. 11 of my U.S. Pat. No. 3,951,047. There appeared however other patents of other inventors after the issuance of U.S. Pat. No. 3,951,047 which teach the wrong assumption, that hydrodynamic pressure would also develop between piston shoes and the actuator face without such specific tapered or inclined portions. For example in U.S. Pat. Nos. 3,948,149 or 4,018,137.

According to this present invention, there will be little or no hydrodynamic action between the outer faces of piston shoes and the inner guide faces of the stroke—actuators, when no inclined face portions are provided. Consequently the teaching of such patents can not obtain the desired minimum of hydrodynamic action. On the other hand, the said inclination portions 66 of my U.S. Pat. No. 3,951,047 are basically correct and they provide an hydrodynamic action. However, they are difficult to be machined and it is difficult to control the accuracy of the machining. Consequently the inclined portions of piston shoes, which have the duty to create a hydrodynamic pressure action, must be improved and this improvement is done by this invention and shown by way of examples in FIGS. 1 to 6.

Figure 1:
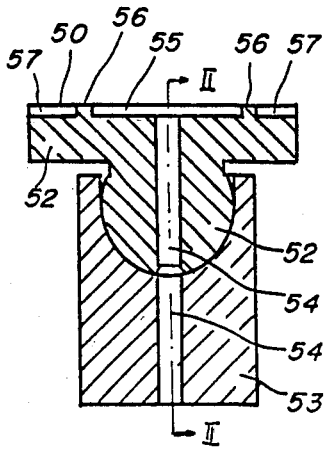
FIG. 1 is a longitudinal sectional view through a piston and shoe.
Figure 2:
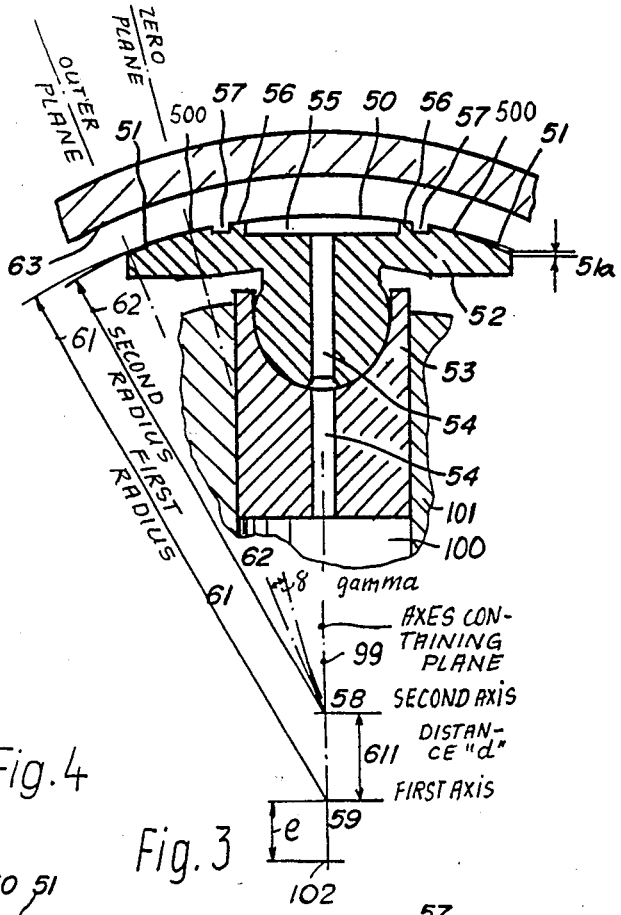
FIG. 2 is a cross-sectional view through FIG. 1 along line II—II.

FIGS. 1 and 2 show the common arrangement of a piston and piston—shoe assembly. FIG. 1 is a longitudinal sectional view through the medial line of FIG. 2. Piston 53 carries the piston shoe 52. Piston shoe 52 is pivotably borne on piston 53. The outer face 50 slides along the inner face of the piston stroke actuator as known from a number of radial piston devices patents. A passage 54 leads pressure fluid from the respective cylinder of the machine through piston 53 and through piston shoe 52 into the fluid pressure pocket 55 in the outer face 50 of the piston shoe. A sealing land 56 surrounds the fluid pressure pocket 55 and thereby forms with said pocket 55 a hydrostatic bearing, as known in the art. Also known in the art, for example, from my U.S. Pat. No. 3,223,046 is to provide unloading recesses 57 outwards of the sealing lands to limit the extension of the sealing lands 56.

Endwards of the unloading recesses 57 remained guide portions with outer guide faces 50, in the former art. These faces 50 however were parallel to the piston stroke actuator guide faces and could therefore not built up sufficient hydrodynamic pressures to prevent contact and welding between the faces.

It should be understood, that there are different kinds of piston—shoes. Those which act with "inter-static" bearings, as FIG. 6 of my U.S. Pat. No. 3,951,047 and those, which require an hydrodynamic action for speedy slide along the other face, such as my piston shoe of FIG. 11 of my U.S. Pat. No. 3,951,047. The present invention deals only with those piston shoes, which require on hydrodynamic action in addition to the hydrostatic bearing of pocket 55 and sealing lands 56.

The difficulties of too little or no hydrodynamic action of the former art are overcome by the provision of the inclined face portions 51 of FIG. 1 and of FIGS. 2 to 6.

Thus, according to the invention, there are guide face portions 50 parallel to the guide face of the stroke actuator face in order to guide the piston shoe accurately along the actuator guide face and there are added by this invention, the inclined face-portions 51. These are slightly inclined relative to the guide face of the piston stroke actuator and they narrow relative to said actuator guide face contrary to the direction of the relative movement. Thus, fluid enters at the wider distanced piston shoe end into the inclined, key-like, space between the piston shoe and the actuator guide face over the inclined face portion(s) 51.

At further movement of the piston shoe along the actuator guide face the fluid enters the narrowing key-space over the inclined face portion(s) 51 and thereby compresses. Since only a portion of the entered fluid can escape laterally or in other directions, a pressure builds up in the key-formed space over the inclined face portion(s) 51. This is an hydrodynamic pressure and prevents the welding between the relatively to each other moving faces, because it is able to carry a load and able to maintain a desired clearance between face portion 50 and the respective guide face of the piston stroke actuator.

The dimension of the angle between face portions 51 and the actuator guide face as well as the dimensions of length and width of the inclined face portion(s) 51 together with the rate of the relative speed between the relatively to each other moving faces will define the total force of the hydrodynamic action onto the face portion(s) 51. Consequently, the face portions 51 of the invention must be designed and machined accordingly. Since they can not create a very high hydrodynamic pressure developing capacity, the main load must be borne by the hydrostatic bearing. Only a small portion of the radial load of the piston shoe can be carried by the inclined face portions 51.

It is further a fact, that a considerable hydrodynamic pressure development capability can be obtained only with very small inclinations of the inclined face portions 51. Because if the angle of inclination between the relatively to each other moving faces is too big, the entered fluid can escape forward in the direction of movement of one of the faces relative to the other of the faces.

Because there would not be enough friction to keep the fluid within the wedge shaped narrow space between the portions of the respective faces. Consequently, no sufficient hydrodynamic pressure could then develop. Thus, in practical application, the inclination 51*a* reaches a maximum of one or a very few hundredth or thousandth of a millimeter distance 51 at the outer end of the piston shoe and between the end portion of portion 51 and the actuator guide face. The machining of such small angle and distance in the required accuracy is very difficult and so is the control of the dimensions thereof.

Accordingly, by this invention, the inclined face portions 51 are so formed and dimensioned, that they can be easily made. The process of building the inclined face portions 51 is therefore also an important part of this invention.

A most simple and convinient way to produce the inclined face-portion(s) 51 is, according to the invention, to insert for example by hand or holder, a piston shoe of the outer radius 61 of outer guide face face 50 into a cylinder portion with an inner face of radius 62 equal to the desired radius of the inclined face portion(s) 51.

By putting a lapping powder between the faces, the assembly man can easily lapp the outer face of the piston shoe, namely face 50 along the inner face 63 of the cylinder portion. The lapping powder gives another color to the lapped portion of face 50. Thereby the assembly man can see and recognize, how far the lapping action has taken place. The length of lapping—in other words, the changed color of the face 50—shall correspond to the length 51 of FIG. 4 or 516 of FIG. 3. As long as the colored length is shorter than the measure 51, the piston shoe is not enough lapped and the lapping should be continued until the length 51 is reached. After such length 51 is reached, the configuration of radius 62 of the face 63 of the part-clindrical lapping tool has produced a very exactly as desired inclined face portion 51 to create the desired hydrodynamic action between the piston shoe and the guide face of the actuator.

In mass production the described hand-production process may be replaced by cutters or grinders with the desired radius 62. The radius 62 has to be defined by design of the piston shoe in order to obtain the desired extent of build-up of the desired hydrodynamic pressure between the piston shoe outer face and the actuator guide face.

FIGS. 2 to 6 demonstrate samples of applications of the inclined face portions 51 of the invention on several different piston shoe types. FIGS. 3 to 6 are views from above upon the guide faces 50 of the respective piston shoe. All face portions 51 of said figures can be produced as described above, At hand-lapping the ends of the piston shoes will centrate themselves in the lapping cylinder on face 63 by putting pressure onto the medial portion of the piston shoe. The lapping of the inclined faces 51 and the production of the inclined face portions 51 will thereby be accurate.

Figure 3:
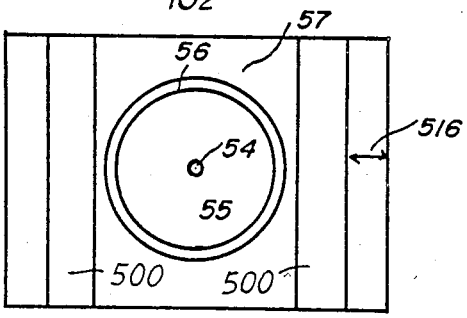
FIG. 3 is a view onto the shoe of FIG. 2 from above.

In FIG. 3 the piston shoe obtains two inclined face portions 51 on the ends of the rectangular piston shoe outer face.

Figure 4:
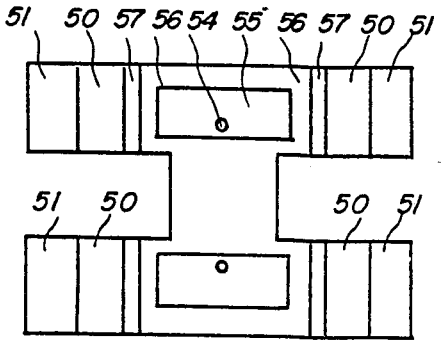
FIG. 4 is a view from above upon another piston shoe.

In FIG. 4 the "H-formed"—deep diving piston shoe obtains four inclined face portions 51 on the ends of the H-guide portions.

Figure 5:
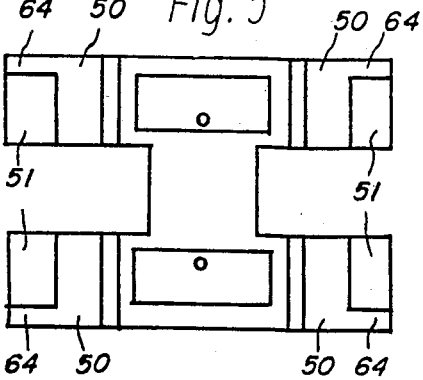
FIG. 5 is a view from above upon a further piston shoe.

In FIG. 5 the inclined face portions 51 are shortened, in order that guiding portions 64 of guide faces 50 remain for the purpose of maintaining a long guide of the piston shoe along the actuator face. To produce the shortened inclined portions 51 the cylindrical tool with radius 62 has to be shorter in the direction of the rotor axis of the machine, than the respective piston shoe is.

Figure 6:
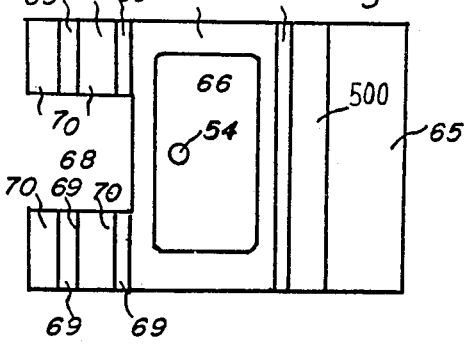
FIG. 6 is a view from above upon still another piston shoe.

In FIG. 6 the forwardly extended piston shoe of my U.S. Pat. Nos. 3,967,540 and 4,075,932 becomes an extended inclined face portion 51 in the forward direction of movement in order to build up a very considerably high hydrodynamic fluid pressure to make it capable of running with very high relative speed along a stationary actuator guide face of the machine.

In the direction contrary of the direction of movement the piston shoe of this forwardly type does not need a strong hydrodynamic action. Consequently the piston shoe of FIG. 6 may on the other end be provided with the slot 68 for the reception of the rotor segments of said patents. The guide face 50 may then on this end be provided with unloading recesses 69 whereby guide face portions 70 are formed at this portion of guide face 50.

For the detailed calculation of the relative inclinations of the exact angles of relative inclination at the respective distances from the axis of the respective piston, namely the angles of inclination between the face portions 51 and the guide face(s) 63 and thereby the relative distances between these faces at the respective locations, the handbooks of the inventor may be read or the respective Rotary Engine Kenkyusho Reports of Rotary Engine Kenkyusho, 24120 Isshiki, Hayama-machi, Kanagawa-Ken, Japan, may be studied. Otherwise the rules of hydrodynamic bearing capacities may apply and these can be found in for example, the following books:

(1) "Theory and practice of lubrication for engineers", written by Mr. Fuller and published by Wiley and Sons of New York;

(2) "Lubrication of bearings", written by Mr. Radzimovski and published by The Ronald Press, also residing in the City of New York.

There are more books in the field. But they are often of a highly mathematical and scientific nature and exceed the need for the common artisan in the field. Generally best and satisfactory informations are obtainable for rather small costs from the books of the Schaum Publishing Company of New York. This concerns mathematics as well as engineering and mechanics as well as fluid mechanics. Regrettably, however, the book "Hydraulics and Fluid Mechanics" of this publishing company, written by Ronald V. Giles, does not have a specific chapter of hydrodynamic bearings.

Figure 7:
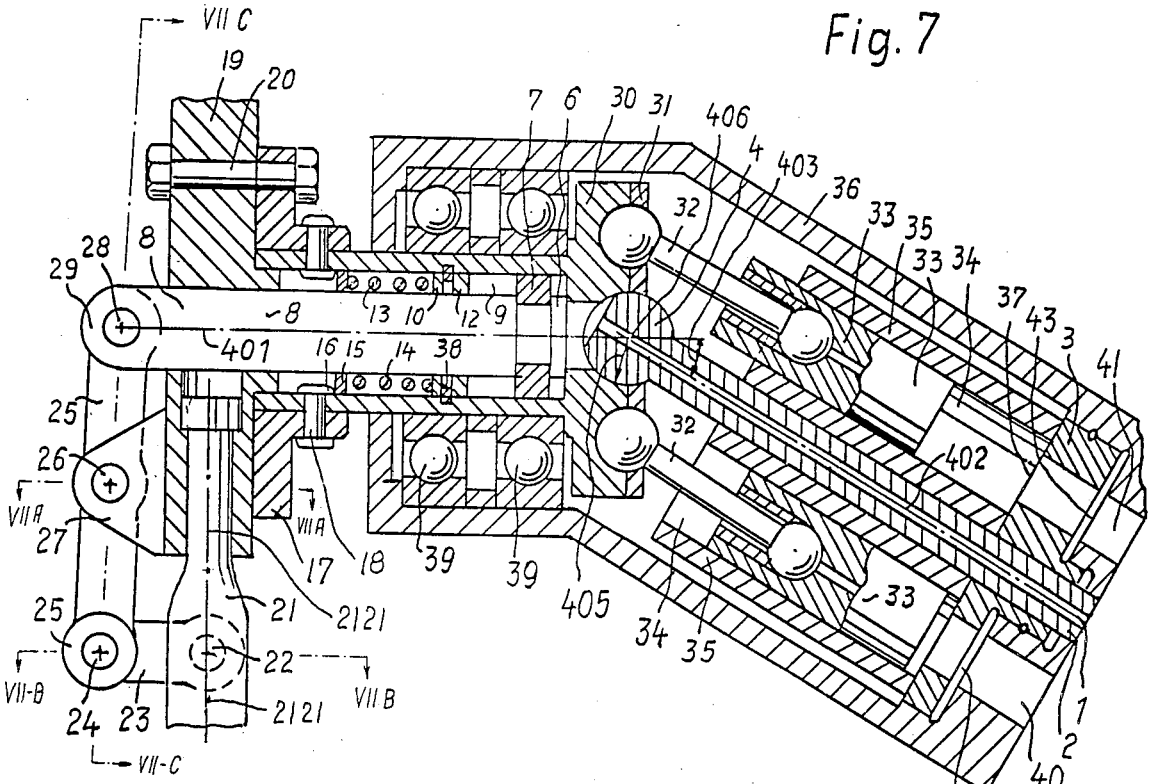
FIG. 7 is a longitudinal sectional view through an axial piston motor.

In FIG. 7 an axial piston type fluid motor is shown. It has the commonly known following parts:

Housing 36 has a control face 37 whereon the rotor 35 revolves. Thereby the flow of fluid from one port 40 or 41 through control faces 37 into the cylinders 34 is controlled and so is the flow out of said cylinders through said control faces to the other of said ports. Control face 37 consists actually of a control-mirror, built by the rotary and stationary control faces 37. Pistons 33 move in the cylinders and transfer the force of the pressure over connecting rods 32 into the flange 30 of driven shaft 38. Shaft 38 is borne and revolving in bearings 39 of housing 36. A medial shaft 2 with connection head 4 in shaft 38 concentrates together with the bearing of the rear end of the medial shaft 2 in the rear end of the housing 36 the rotor in the housing 36. The connecting portion or of the medial shaft 2 has the form of a part of a ball. So far the motor is well known from the former art. Also known from former art, however from U.S. Pat. No. 3,743,924 of the inventor, is the possibility to provide the stationary control face 37 on a control body 3, which may be pressed by fluid pressure in a thrust chamber 42 or 43 against the rotary control face 37 of the rotor 35. The application of control body 3 is, however, not absolutely necessary. The rotor may also be pressed against the stationary control face 37 if the control face is stationary provided on the rear-cover of housing 36.

According to the invention, a control flow fluid line 1 is led through the rear portion of the housing 36, through the medial shaft 2, through the control face pair 37, through the holding head 4 and through a portion of driven shaft 38 into a respective chamber 9 in portion 38 of driven shaft 30–38. The driven portion 38 of driven shaft 30–38 is hollow and contains the thrust chamber 9, whereinto the described control flow of the invention is led. In chamber 9 a control-piston 8 is reciprocably located. It is pressed towards the bottom of chamber 9 by spring means 14. Spring means 14 is located in chamber portion 13 and held by retainer members 15–16 in chamber portion 13 in shaft portion 38 to press against the neck 10 of control piston 8. Thereby control piston 8 is pressed towards the bottom of chamber 9. Chamber 9 is sealed by seal piston 12, which is held in neck 10 and which is reciprocable together with control piston 8. When the control flow of the invention is led into chamber 9, the pressure in the control flow 1 presses the pistons 8-10-12 away from the bottom of chamber 9 and thereby compresses spring means 14. The communication 5 in shaft 38 communicates the chamber 9 of the driven shaft 38 with the passage 1 of the medial shaft 2. The ring or divided ring 7 may be provided on piston 8 if so desired.

A flange 17 may be fastened by fasteners 18 to the hollow shaft portion 38. Flange 17 may carry a propeller portion 19, which may be fastened to flange 17 by fasteners 20.

Control piston 8 may extend into or through the propeller portion 19 and may end with a connecting portion 28 to connect a transmission member 25 by connecter 29 to connecting portion 28. Propeller portion 19 may carry at least one bearing portion 27 to bear therein a bearing pin 26 to bear pivotably thereby the transmission arm 25. Propeller blades 21 may be pivotably borne in propeller portion 19. Propeller blades 21 may have a connection member 22 to carry thereon another transmission-arm 23, which on the other end is connected to the other end of arm 25 by connecter means 24.

Thus, when no pressure enters as control flow into chamber 9, the spring 14 presses the propeller blades 21 into the position of small angle of attack or into the auto-rotation position. When pressure in fluid in the control flow 1 of the invention enters into chamber 9, the control piston 8 is moved outwards and the described connection means and transmission means then press the propeller blades 21 into a position of a higher angle of attack. The propeller can now be utilized as a helicopter propeller or as an aircraft propeller to drive the aircraft forward.

The setting of the angle of attack of the propeller blades by the control flow of the invention through the fluid motor of FIG. 7 and of some other of the figures of the specification can be done steplessly variable. A higher pressure in the fluid flow will compress the spring 14 more than a lower pressure would do and consequently the angle of attack of the propeller blade will be steplessly variable depending on the stepless variable pressure in the control flow 1 of the invention.

The upper portion of the propeller portion 19 may carry another propeller blade. Thus, there may be a plurality of propeller-blades 21 be provided and be borne by or on propeller-portion 19. All propeller blades may be connected similarily as that on the bottom of the figure to the control-piston 8 and thereby to the common control flow 1 of the invention. Thereby the adjustment of angles of attack of all propeller blades will act in unison.

Instead of utilizing the control flow of the invention for the adjustment of the angle of attack of a propeller, it might also be used for arresting purposes or for other purposes, as demonstrated in other figures of the invention. Actual design may reverse directions of actions.

Figure 8:
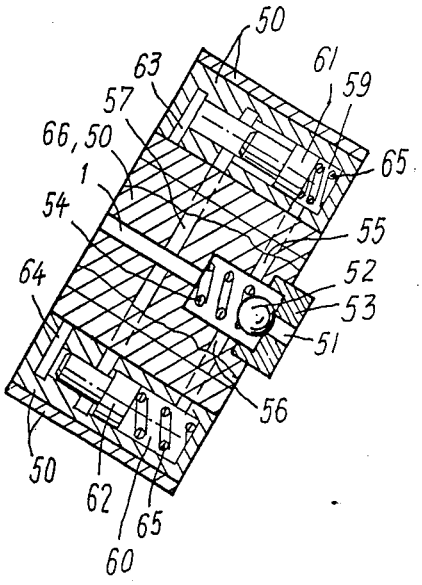
FIG. 8 is a longitudinal sectional view through an adapter.

FIG. 8 contains a control means which may be either built into a cover or housing of a fluid motor or which may be built into an adapter set-housing 50. Such adapter housing 50 can be flanged onto the end of a respective motor, for example onto the right end of FIG. 7.

The feature of the control device of FIG. 8 is, that the control-flow passage 1 of the fluid motor will automatically be communicated to the driving high pressure fluid line to the motor as long as no specifically relatively higher pressure is send intentionally to control fluid line 1. Housing portion 50 contains at least one control-cylinder 59 and/or 60. One end of such control cylinder may be communicated to fluid port or passage 41, for example by communication passage 63. The other cylinder 60 may be connected by passage 64 on one end of said cylinder 60 to port or passage 42 of the motor, if such cylinder 60 is provided. The control-cylinder(s) 59,60 contain(s) a control-piston 61 or 62. The other end of the respective control cylinder 59 or 60 contains a spring means 65 in order to press the respective control piston 61 or 62 towards the other end of the control cylinder 59 or 60. From the medial cylinder portion of control cylinder(s) 59 or 60 a respective passage 57 or 58 extends bypassing passage 41 or 42 through a portion of housing portion 50 to the control flow fluid line 1 of the invention.

A control flow connection 51 extends from a closure member 53. When a control flow of higher pressure shall be intentionally send to the control means of the motor, such higher pressure control flow will be send to connection port 51. The one-way valve 52 is pressed by spring means 54 into a closing position on closure member 53. Thereby control flow line 1 is closed toward control flow port 51.

On the spring-side end of the respective control cylinder 59 or 60 a respective other passage 55 or 56 extends through another portion of housing portion 50 bypassing the respective ports or passages 41 or 42 into the control flow fluid passage 1.

The springs 65 are so strong, that they are able to move the respective piston 61 or 62 into a position to close the communication between passages 63 and 67 or 64 and 58 when low pressure acts in the respective fluid port 41 or 42. Such low pressure is present commonly in the return fluid port from the motor.

The springs 65 are however not strong enough to resist the pressure in the high pressure fluid delivery port or passage 41 or 42. Thus, the port or passage 41 or 42 which is communicated to the respective cylinder 59 or 60 sends high pressure delivery fluid into the one end of the respective cylinder 59 or 60 and thereby presses the respective piston 61 or 61 against the respective spring 65, compresses the respective spring 65 and thereby opens the communication between passages 63 and 57 or between 64 and 58, while the low-pressure connected passage 63 or 64 remains dis-communicated from the respective passage 57 or 58 and thereby closed to the respective passage 57 or 58. Thus, the high pressure fluid from the high pressure fluid delivery line to the respective motor is led through port or passage 41 or 42 into the control flow fluid line 1 of the respective fluid motor. The size of pressure in the delivery fluid thereby controls the size of angle of attack of the associated propeller blades. Thus, a higher pressure in the delivery fluid line will automatically stiffen the angle of attack of the propeller blades. This is specially convenient for aircraft and helicopters, because a higher pressure is present when a higher power is used. The work of the pilot to increase the angle of attack of the propeller blades, when he intends to fly or climb faster with higher power is now, according to the invention, taken over by the delivery pressure in the delivery fluid flow of the invention. The pilot is spared from this work and the attention to it.

When it is desired to rise the angle of attack of the propeller blades still higher, for example by addition of an additional power boost engine, a control flow fluid pressure of higher pressure than in the delivery fluid line 41 or 42 is led by pilot's or other control-action to fluid line port 51. This higher pressure thereby opens valve 52 against the pressure of the delivery fluid line 41 or 42. The pressure of control flow 51 now enters into both cylinder spring ends 59 and 60 and closes both communications 63–57 and 64–58 by moving both pistons 61 and 62 into the closing position. Thereby the fluid ports or passages 41 and 42 are discommunicated or closed from the main fluid flows 41 and 42 and the control of the angle of attack of the propeller blades or of any other control member controlled by fluid line 1 is now controlled by the fluid pressure in pressure control line 51.

Thus, as long as the pressure in fluid in line 51 is higher than the pressure in the delivery fluid 41 or 42, the control action by control fluid flow line 1 is done by the pressure in port 51, while, when the pressure in fluid port 51 is lower—or no pressure—, the action of control is then done automatically by the high pressure in the high pressure delivery fluid line 41 or 42. Valve 52 is then closed.

Figure 9:
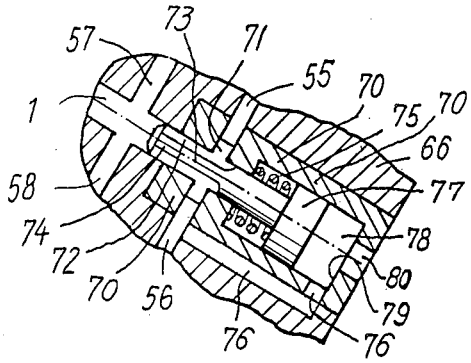
FIG. 9 is a longitudinal sectional view through a control means.

Instead of providing valve 52 of FIG. 8 it is also possible to set the valve assembly of housing portion 66 of FIG. 9 into the housing portion or adapter 50 of FIG. 8.

Valve housing 70 contains a chamber 78 with a control-piston 77 reciprocable mounted therein. The spring 57 drives the piston 77 towards the bottom of chamber 78 and thereby opens the communication of passages 55 and 56 to control fluid line 1. At same action the end of piston 77 closes the port 80 by acting as a closing valve on valve seat 79. The automatic control of the control action by the pressure in fluid in delivery line 41 or 42 is now acting. As soon however, as a remote controlled control-action is desired, a fluid under higher pressure than the pressure in the delivery main fluid line 41 or 42 is, is led to port 80. Thereby control piston 77 is pressed against the spring 75, compresses spring 75 and closes with piston-portion 72 the communication of passages 55 and 56 to the control fluid line 1. When the control-piston 77 under the pressure in fluid line 80 has reached the maximum spring-compressed position, fluid passes from the over-riding remote control fluid line 80 through the open valve seat 79 into chamber 78 and from there through passage 76 into passages 55 and 56 to close pistons 61 and 62 for closing passages 63 and 64 from passages 57 and 58. In this position control recess 71 communicates with control recess 73 of piston portion 72 and opens thereby the passage 74 to control-flow fluid line 1. The control of the controlling action is now done exclusively by the pressure in remote control flow 80, while the passages of the main operation fluid lines 41 and 42 to the respective fluid motor are cut off and closed.

The possibility of the arrangement of the invention, to either have an automatic control of a by the pressure in the main fluid flow delivery line to be controlled adjustable member to disconnect said main delivery flow from the mentioned automatic control and utilize a different pressure range for an over-riding control adds new possibilities to the operation of machines and vehicles especially to aircraft, helicopters and gyrocopters as well as to propeller-blade control of other vehicles.

In the axial piston motor or pump of FIG. 7 the control flow was led through the medial shaft 2 and its head 4. The holding of the rotor 35 in axial direction was not defined in FIG. 7 because it was immaterial to the arrangement of the control flow through passage 1. In actual application however, the element 4 may have a holding shoulder as in my now abandoned patent application 06-064,248, which axially bears the rotor against the thrust of the control body 3. The head 4 of the element 2 then carries the axial load from the control body in the spherical bed of flange 30. To carry said load, which increases with pressure in fluid in cylinders 34 and is thereby parallel to the operation pressure of the device, requires a hydrostatic fluid pressure field between head 4 of element 2 and the bearing bed in flange 30. This hydrostatic bearing must then be supplied with a pressure equal to the operating pressure in the cylinders 34. The mentioned hydrostatic bearing with pressure equal to that in the cylinders 34 takes most of the space on the face of head 4 away. On the other hand, it is also desired, that an axial piston motor should have an angle of inclination of 45 degrees if possible, between the shaft and the axis of the rotor to obtain the highest possible torque and efficiency.

Figure 10:
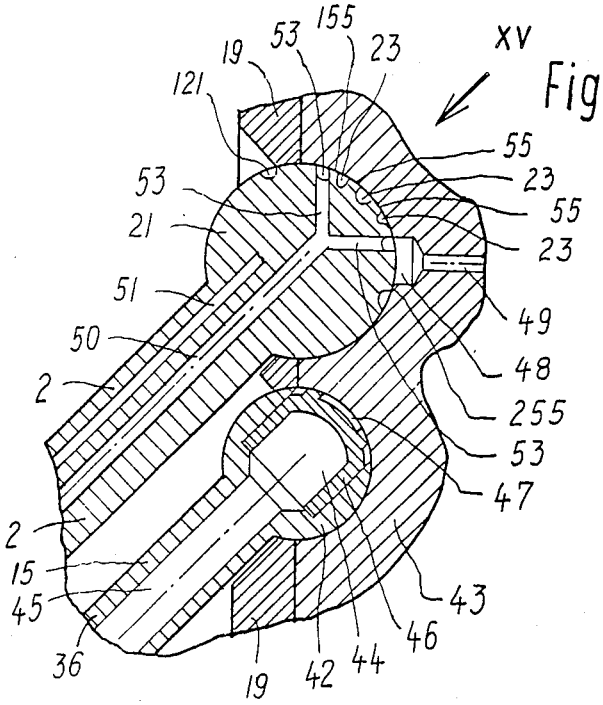
FIG. 10 is a partial sectional view through an axial piston device.
Figure 15:
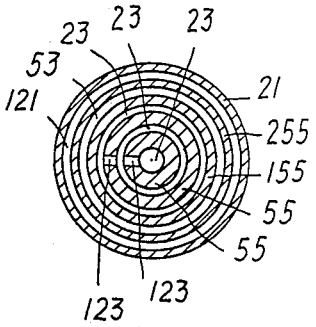
FIG. 15 is a view from the end upon the head of an element.

The control of the movement or pivotion of the controllable member 21 driven by the motor and associated to the shaft 38 of the motor or pump should be controlled sometimes by a pressure different from the pressure in the cylinders 34, namely by a pressure in control fluid line 1. In such cases, the passage from the element 2,4 to the shaft 38 must be provided separately between the head 4 of element 2 and the flange 30 of shaft 38. How this may be provided is shown by communication space 5 and illustrated further in FIGS. 10 and 15. In FIGS. 10 and 15 the element, rotor portion or medial shaft 2 is provided with two separated passages 50 and 51. Passage 51 carried the fluid and pressure from the cylinders 34 or the high pressure control port. Passage 50 however, carries the fluid and pressure of the control flow, which may be supplied and controlled also by remote or automatic control.

The working pressure of the high pressure control port is led through passage 51 into the hydrostatic pressure field 23,55. This may for obtaining of a maximum of bearing capacity, have a number of recesses 23 and bearing faces 55. See also FIG. 15, which is seen in the direction of arrow XV in a section slightly below the outer face of head 21 of element rotor portion or medial shaft 2. The bearing faces 55 are located between two adjacent recesses 23 and thereby lubricated under pressure fluid force from both ends, whereby they obtain the high bearing capacity of the invention.

The several recesses 23 may be communicated with each other through bores or communications 123 in order to fill all of the recesses 23 with working pressure fluid and thereby to enforce the lubrication of the bearing faces 55 therebetween, whereby an effective hydrostatic bearing is formed between head 21 of element, rotor portion or medial shaft 2 and flange or shaft 43. Head 21 is fastened to flange or shaft 43 by holder 19 in such a way , that head 21 can still slide spherically in the bed of flange or shaft 43. Shaft 43 has a passage 48 to lead to a respective chamber, f.e.: chamber 9 of FIG. 7 with a controllable member or piston 8 therein.

The control fluid flow, which is led through passage 50 may pass into a passage extension 53 and port into the control flow recess 53. Control flow recess 53 is separated from the hydrostatic bearing by a common seal face 155 which may obtain in the clearance a fluid pressure of a height between the working pressure of passage 51 and the control flow pressure of passage 50. In the other radial direction the control recess 53 which is in the Figure an annular ring groove, is sealed by the sealing land 255. On the outer end of the sealing land 255 an unloading recess 121 may be provided which unloads at the top-left of FIG. 10 in the neighborhood of referential number 121 into the empty or low-pressure filled housing of the pump or motor.

In a 45 degree inclination between axis of shaft and axis of rotor-device, the annular ring groove, the control flow recess 53, can not easily meet the passage 49 which represents the passage 5 of FIG. 7 here in FIG. 10. Because when the control recess ring groove 53 is led too far outwards, it can not be sealed any more in the hollow half-ball formed bearing bed in flange or shaft 43. See hereto the referential line of 53 in the upper portion of FIG. 10. The control recess ring groove 53, therefore obtains a location as geometrically demonstrated in FIG. 10. If, the location would be different, a 45 degree inclination between the shaft and rotor would not be possible. To secure that the annular groove 53 can at all times of rotation of the shaft 43 communicate with the passage 49, this passage 49 must either be of a suitable diameter or be provided with a port 48 of a respectively and precisely located and dimensioned diameter in order to meet the control recess ring groove 53. This communication is demonstrated in FIG. 10. The sealing land or face 255 must here become so large dimensioned in radial direction around the part-ball head 21, that the port or passage 48 or 49 can never meet the unloading recess 121. In short, communication of port or passage 48,49 with unloading recess 121 must be prevented by a suitable dimensioning and location of sealing face or sealing land 255.

When the arrangement is done as shown in FIG. 10 of the invention both aims are perfectly achieved. The hydrostatic bearing is provided on head 21 of element 2 and the control flow is separately passed through element 2 and head 21 the part 48 of into the transfer passage 49 to the shaft and the means to actuate and control the controllable member operated by the control flow through the device.

For high revolutions of the device the invention desires to reduce the centrifugal force of the conrods between the pistons and the flange or connection flange 43. That is done in the bottom portion of the invention thereby, that the head 42 of the respective connecting rod 15 is hollow and obtains a bearing insertion 46 with fluid pressure balancing pocket 47 therein. The insertion 46 may also be hollow to reduce the weight of the connecting rod 15 and its head 42. The shaft 36 of connecting rod 15 may also be hollow. The hollow spaces, here described, may however be filled with light weight non-compressible material in order to prevent compression in fluid in the hollow spaces because compression in fluid at high pressure in fluid leads to a volumetric loss proportionate to the volume of the hollow space.

The reduction of weight of the connecting rods and of their heads in FIG. 10 is very considerable. This reduction of weight of the conrods is very important at high revolutions, because at high revolutions the centrifugal force of heavy conrods with heavy heads is very high. The centrifugal force tends to force the conrods at high revolutions radially outwardly and thereby one-sided on the wall faces of their respective beds and holders in the flange 43 and its neighborhood. There they are producing an increased friction and wearing, when the weights of the conrods are high as in the past and when the revolutions of the rotor and shaft of the device are high.

In FIGS. 11 to 14 means are shown which are related to fluid flow facilitating machines which have radially expanding working chambers and a cylindrical rotor bore, which may also be called a rotor-hub.

A cylindrical control body was proved in said rotor hub and controlled the flow of fluid to and from the working chambers in the machine. A narrow clearance was provided between the outer face of the control body 1 and the inner face 28 of the rotor 10 to seal against leakage losses between said faces.

When the radially acting working chambers 5 with displacement members 6 associated thereto have entrance-exit passages 4 of a smaller cross-sectional area than the chambers 5 have, a pressure of the fluid acts against the bottom of the chamber 5. For example, if the chambers are cylinders 5 which have a diameter 8 and the passages 4 to the respective cylinders 5 have a diameter 7, then the pressure acts onto the bottom of diameters 7–8 of the cylinder with a force "Fr"$=(8\phi^2-7\phi^2)(\text{pi}/4)\times p$ with p=pressure in the fluid in the cylinder. This force "Fr" can be utilized to press the rotor 10 with its inner face against the outer face of the control body 1 at one half of the control body. In order to obtain this pressing action for narrowing the said clearance on the pressure-half of the machine, it is necessary to eliminate the contrary acting pressure in fluid in the said clearance by the provision of unloading recesses 9 which are communicated to a space of no or of low pressure. The location and dimensioning of the said recesses 9 in combination with the said diameters 8 and 7 define the force with which the said clerance between body 1 and rotor 10 is narrowed on the pressure half of the machine.

Such arrangements have worked quite satisfactory, but they have not obtained the optimum of efficiency, because there remains a certain leakage due to a widening of the clearance on both peripherial ends of the high pressure zone. This fact was found by this invention and the invention now provides means to improve the volumetric efficiency of the machine and also the total efficiency of the machine by reducing the leakage through the clearance of the high-pressure half of the machine.

Figure 12:
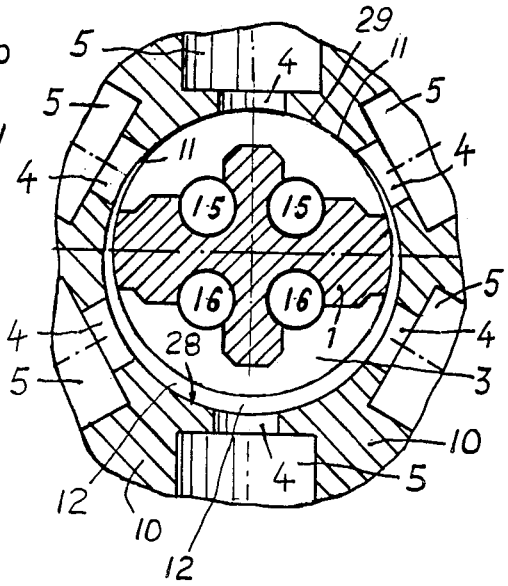
FIG. 12 is a cross-sectional view through FIG. 11 along line XII—XII.
Figure 13:
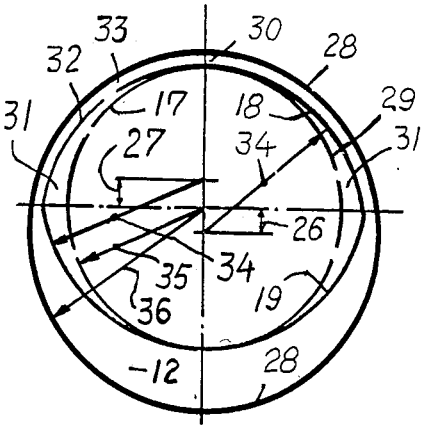
FIG. 13 is a schematic explanation.
Figure 14:
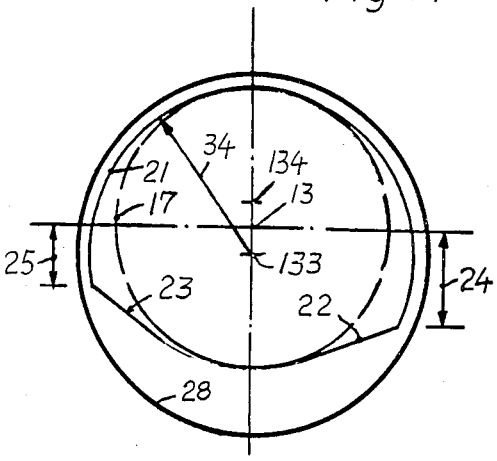
FIG. 14 is an other schematic explanation.

The clearance 11–12 is also shown in FIG. 12 and FIGS. 13–14; however, in a drastically enlarged scale. Actually the clearance between inner face 28 of rotor 10 and outer face 29 of control body 1 is only around a hundredth or a few hundredth of a millimeter.

When no pressure acts in the machine, then the rotor 10 may float substantially centrically around the axis of control body 1, whereby the clearance would be substantially equal all around the control body. When however, a pressure builds up in one half of the machine, the rotor is pressed under the described force "Fr" towards the controlbody within the pressure half of the machine. The rotor then revolves not any more around the controlbody axis 13, but around a radically displaced eccentric axis 33. Thereby the area around 30 of the clearance 11–12 becomes narrow and prevents or reduces leakage. There remain, however, areas about 90 degrees remote, which have the nummeral 31 and which are not considerably narrowed and which reduce leackage only slightly. From location 30, the narrowest area, the clearance widens gradually until areas 31 on both sides. The system can therefore not close the clearance area 11, but reduce the clearance area 11—the high pressure area—just about to a half of the former circular cross-sectional area. Such reduction to only one half of cross-sectional clearance area can not obtain an optimum in reduction of leakage.

Consequently, according to the invention, the diameter 29 of the controlbody becomes made about equal to the inner diamter 28 of rotor 10 on the high pressure zone of the machine, but with a radius 34 of (½) 28 around the eccentric axis 133 instead of around the axis 13. This one half of the outer face 29 is shown in FIG. 14 schematically by 32. The clearance 33 between 28 and 32 has now, according to the invention, the same radial size all over the high pressure half of the machine and consequently the reduction of leakage therethrough is now according to the invention, an optimum.

The bottom half of the control body, which now is the low pressure half, gets an equal radius 34, as the pressure half has got and forms the outer face portion 19 around the eccentric axis 134. The dotted line 17 with radius 35 is the former cylindrical control body.

By this arrangement the clearance on the low pressure half widens to the wide portion 12. This would generally be acceptable on the low pressure zone. However, the danger might arise, that the pump sucks air through the widened clearance portion 12. Therefore, according to the invention, seal members 14 may be inserted into seal beds 13 to close the clerance 11 or 12 in axial direction.

It is apparent from FIG. 13, that, when the fluid flow direction becomes reversed, so, that the bottom portion will become the high pressure half, the rotor will move upwards to revolve around the upper eccentric axis 34. The actions are then replaced diametrically.

In order to compress or precompress the fluid in the working chamber 5 when it revolves over the control arc between the low pressure and high-pressure half, it may be good to extend the face portion with radius 34 over more than 180 degrees, for example by extension 24 in FIG. 24 for move of chamber 5 from low- to high-pressure half and by extension 25 for movement of chamber 5 from high- to low-pressure half. The chamber 5 is then ideally closed not only in the high pressure zone, but also in the control arcs between the high- and low-pressure zones. The inclinations or recesses 22 and 23 may then be formed on the outer face of the control body in order to obtain an ideal silencing by gradually opening and closing the chambers 5 to the low-pressure control port of the machine.

By the above arrangement the leakage in fluid flow handling machines with cylindrical rotor hubs can be drastically reduced and the efficiency and power of the machine can be increased. The machine may now be economical also for a higher pressure range of pressure in fluid.

Control body 1 has fluid passages 15 for one flow direction and fluid passages 18 for the other direction of flow of fluid as well as the control ports 2 and 3.

The arrangement may be done for one directional flow machines as well as for two directional flow machines and it may be applied to single chamber group machines as well as to multi chamber group machines.

In devices with radial flow of fluid into and out of the rotor of a fluid flow facilitating machine, a control body with passages and ports to the channels in the rotor to the working chambers is located in a central bore or hub of the rotor. The central bore of the rotor has a wall which forms the inner face of the rotor and the control body has an outer face which faces the inner face of the rotor. There are three basic systems of this arrangement. The first is, to provide a bearing between rotor and control body as already teached in Walter Ernst's book "Oil hydraulic power and its industrial applications" of 1960, Mc.Graw Hill, N.Y. One of the next systems is the provision of a fixed stationary control body and a floating rotor around it. There is a flexible clutch provided between the fixed control body and floating rotor. This is shown in the catalogue "HOWA-EICKMANN PRAKTISCHE HYDROUMPEN" of December 1962 and, for example, in inventor's U.S. Pat. No. 3,223,046 this system is called: "The floating rotor". The third system is, to mount a radially fixed rotor in antifriction bearings in a housing and a radially flexibly mounted control body into the central rotor bore. The control body is then provided with means, which permit it to follow unaccurate movements of the rotor. The control body also has provisions to float between fields of pressure of fluid in the rotor. This third system, shown, for example, in inventor's U.S. Pat. No. 3,062,151, is called: "The floating control body".

Of the mentioned three systems, the first system is now outdated for high pressures, because the required clearance between the outer face and the inner face is rather big, because the bearings themselfes have already a clearance. Since welding between the mentioned faces must be prevented, the actual clearance between them must in the first system be rather wide, which causes big leakage at high pressure. The second and third systems are both still applicable, also at medial pressures, because in these two cases, due to radial flexibility of either the rotor or the control body, the clearance can be rather narrow. The sealing of the two latter systems is much better than the first system.

However, even at the two mentioned latter systems, a minimum of clearance between the outer face of the control body and the inner face of the rotor is required. It is commonly about one thousandth of the diameter of the inner face of the rotor. In very accurate cases, where all influences of deformation under local heating are prevented, the diametric clearance goes down to about 6 tenthousandth of the diameter and thereby the radial clearance to about three tenthousandth of the diameter of the inner face of the rotor. When the clearance is made still smaller, the faces tend to weld on each other. The device is then no more reliable in operation. Such narrow clearance between the faces is of good efficiency at medial pressures about 3000 psi and at limited rpm, for example 1500 to 2000 rpm. At higher pressures and rpm also the two latter systems are becoming somewhat uneconomic, because even these small clearances cause unacceptable high leakage at higher pressures and/or higher revolutions per unit of time of the rotor.

Thus, the consequences of known technology are, that a clearance between the faces should in average not be reduced below about a thousandth of the diamter of the cylindrical faces in total measures of the sum of clearance or to about five tenthousandth of the diameter of the faces one the radial clearance.

That leaves as the only solution for a still better sealing and for reduction of leakage through the clearance between the faces the application of specific seal means in the neighborhood of the control ports of the outer face of the control body.

Figure 17:
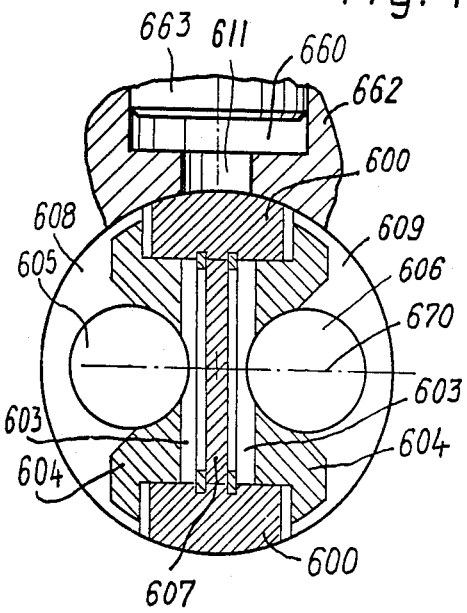
FIG. 17 is a cross-sectional view through FIG. 17 along line XVII—XVII.
Figure 16:
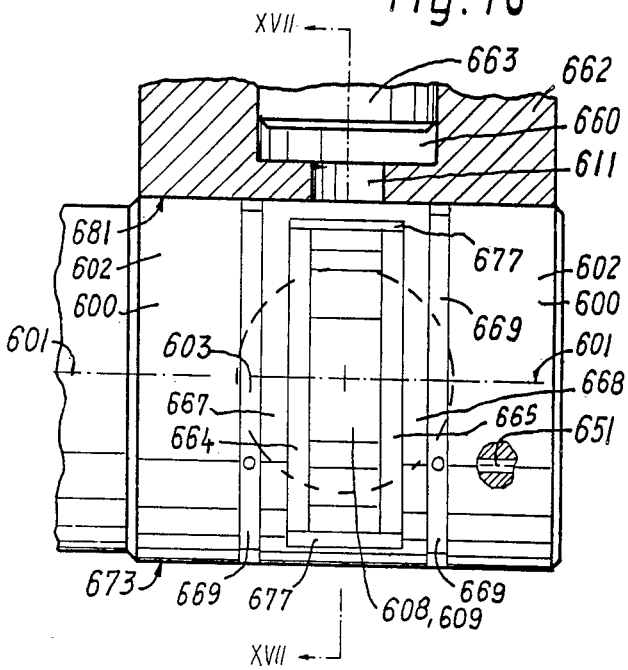
FIG. 16 is a view towards a control body, partially in a rotor.
Figure 18:
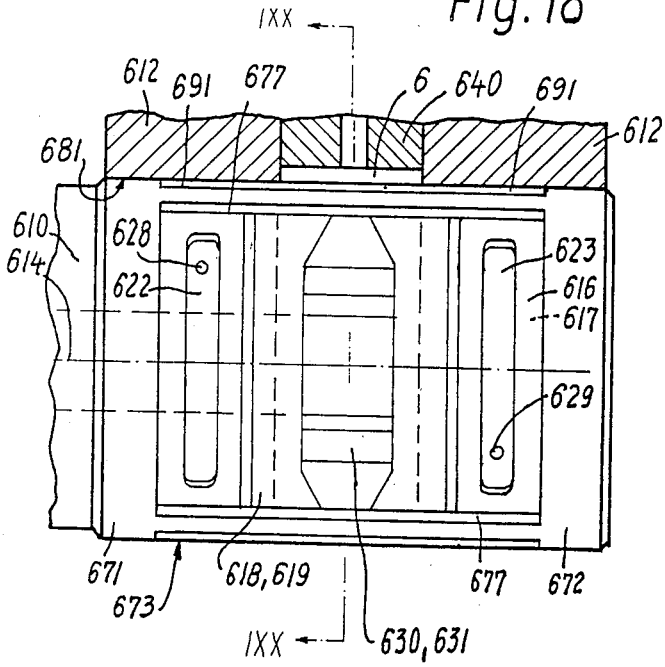
FIG. 18 is a view towards another controlbody partially in a rotor.

For such specific seal means a number of proposals have been done in the last decade and the present invention of FIGS. 16 to 18 deals with specificly effective seal means adapted to the outer face of the control body and to the inner face of the rotor.

In the embodiment of FIGS. 16 and 17, the rotor has radially directed cylinders or working chambers 660 with for example pistons 663 therein. The speciality of the rotor 662 is, that each cylinder 660 has a rotor passage 611, which extends from the bottom of the cylinder radially inwards to and through the inner face 681 of the rotor 662. The mentioned passage 611 is of a rather small diameter on cross-sectional area relative to the diameter of the cylinder 660 or relative to the cross-sectional area of the working chamber 660. In other words, the cross-sectional area of the rotor passage is only a fraction of the cross-sectional area of the associated cylinder or working chambers.

Thereby a force is formed on the bottom of the working chambers, which forces the rotor bottom down towards the control body 600. On the other hand, the control port 609 or 808 of the control body together with the surrounding sealing land 667,668 is so dimensioned, that the force in opposite direction out of the control ports and their sealing lands are in counter directed balance with the forces onto the cylinder bottoms. The rotor 662 and control body 601 are thereby radially substantially in a balance of directionally opposed forces of fluid. That permits a rather concentric and rather friction-less operation of the control body 601 in rotor 662.

The embodiment of FIGS. 16 and 17 is now arranged to such kind of rotor and control body, where the mentioned substantial radial balance of forces of fluid in the described locations is existing.

Figure 19:
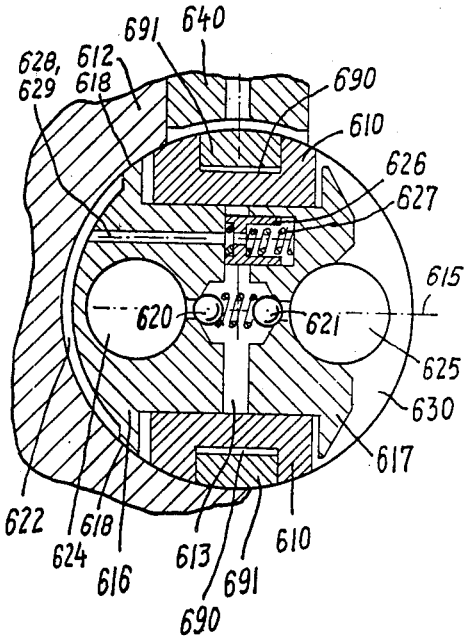
FIG. 19 is a cross-sectional view through FIG. 18, along line IXX—IXX.

On the contrary thereto, the embodiment of FIGS. 18 and 19 is applied to such kind of rotor and control body, where the described substantial radial balance of forces in the mentioned area of location does not exist.

The invention of the embodiment of FIGS. 16 and 17, which overcomes the high leakage at high pressure or rpm and reduces the said leakage considerably, consists in the provision of at least one hollow space 603 with a therein moveable thrust body 604 which includes a control port 608 or 609 and a sealing land 664 or 665 therearound and which is pressed by pressure in fluid on its bottom in the mentioned space into sealing engagement with the respective portion of the mentioned inner face 681 of the rotor 662. For simplicity of manufacturing the hollow space may be a simple cylindrical bore with an axis 670 substantially normal to the longitudinal axis 601 of control body 600. The mentioned hollow space is provided in the control body 600. It may also be a bore extending completely through control body 600 along and around the normal axis 670. Thereby it may form two hollow spaces 603 and it may then contain two oppositionally directed thrust members 604. A separation-and sealing-wall 607 may be provided in such space to separate one space 603 from the other, or there may be two separated spaces or bores 603 separated from each other by an integral portion 607 of control body 600.

It is in this embodiment required, that the sizes of control port 608 or 609 with the sorrounding sealing lands 664,665 are located within outer face sealing land portions 667,668 and that the size of the control port and the mentioned sealing lands are properly dimensioned to upheld the before described substantial radial balance of fluid forces in the location and area here discussed. That results in axially rather narrow control ports and sealing lands, as shown in FIG. 16. It may be noted, that the ends of the thrust member(s) 604 closely fit between walls of respective outcuts in control body 600 to seal there along, or, that seals are inserted on the axial ends of the thrust bodies 604 to accomplish the mentioned seal. In the drawing those seals, which may be plastic seals, like rubber, teflon or the like, are not shown in order not to complicate the system which is explained in the Figure. Endwards of the sealing land portions 667,668 of the outer face of the control body, which embrace the sealing lands of the respective thrust body 604, there should be unloading recesses 669. They serve to prevent extensions of pressure zones and thereby to definitely restrict the mentioned location and area of substantial radial balance.

Unloading recesses 669 may either be communicated together by passages 651 or they may be communicated by passage(s) 651 with the interior of the housing of the device or with any desired or suitable space of no or of only low pressure. The unloading recesses 669 may also be incorporated into the fluid supply into the clearance between the mentioned faces over face portions 602 in order to build up there hydrodynamic pressure fields, which assist the concentration of the rotor and the control body relative to each other when the rotor revolves around the control body and the fluid flow facilitating device thereby operates.

In the later years of the last decade a leading european corporation has attempted to use two separated control body portions and to press them by pressure between them into sealing engagement on the inner face of the rotor. The corporation even obtained a patent thereon. The fact however is, that even when the patent makes an impression of geniality and good effect, it actually can not work. Because, when two halves of controlbodies are pressed against the inner wall of the rotor, a gap appears between the two control bodies. The mentioned corporation proposed to insert seal packages into this gap to build pressure chambers to press the controlbodies away from each other and against the mentioned inner face of the rotor. The space radially of the seal, however, remains open. The result of the errenous solution is, that, when the respective passage 611 of the chamber 660 revolves over the mentioned gap between the two control bodies, the pressure in the chambers or cylinders suddenly reduces or disappears, because the cylinders are suddenly open to the space under no pressure in the housing of the device. This occurance appears at least two times at a single revolution of the rotor. The result thereof is a terrible noise and vibration and in addition, that a very large percentage of the piston stroke or of the working chamber action is open to the gap and thereby lost from the action of pumping or from the driving of the motor. When the cylinders or chambers 660 finally close the pistons or displacement members are already under a very stiff contraction or expansion-action with a already high radial velocity. The then sudden closing results in unacceptable high vibrations noise, and very sudden, big load impulses, which in addition to make noise quickly disturb the device.

The embodiment of the invention overcomes the problem not absolutely perfectly but with a very high degree of efficiency.

Also in the invention of FIGS. 16 to 19 such a gap remains and is demonstrated by referential numbers 677. The mentioned gap 677 of the invention is, however, not open to the interior of the housing or to another low-pressure space, but a portion of the control port 608,609 in FIGS. 16,17 or of control ports 630,631 in FIGS. 18 and 19. The gap 677 is sealed against major losses of leakage by the fit of the outer face of the respective control body 600 or 610 on the inner face 681 of the rotor 662 or 612.

Since the inner and outer faces of the rotor and of the control body do, according to the above disclosure, not weld, when the clearance between said faces is diametrically about a thousandth of the diameter of the faces or radially about five tenthousands of the said diameter of the faces (inner face of rotor and outer face of control body) the sealing between these faces is still as perfect as in applicants mentioned elder patents. Thus, only a very small leackage can escape from the gaps 677 through the clearance between the mentioned faces. In actual devices it is about a twentieth to a fourieth of the leakage of the devices of the inventor's elder patents. Thereby it is not absolutely perfect, but certainly the reduction of leakage to a twentieth of the devices of the elder patents is a very effective and appreciable solution.

For details it should be noted, that an escape in radial direction between the ends of sealing lands 664 and 665 and the neighboring walls of control body sealing lands 667 and 668 in FIGS. 16 and 17 and of the ends of thrust bodies 616,617 of FIGS. 18 and 19 and the neighboring walls of control body sealing lands 671, 672 should be prevented either by a close fit of the respective thrust body between the walls of the respective recess wherebetween the respective portion of the respective thrust member is located, or by seals between the endwalls of the thrust members and the walls of the respective slot portions. The slots may also be called: "outcuts".

The here often mentioned inner face of the respective rotor is shown by the arrow 681 in FIG. 18 and the respective outer face of the control body by arrow 673 in FIG. 16.

The embodiment of FIGS. 18 and 19 is especially suited for such a device, where the working chambers 6 do not have narrowed passages 611 of FIG. 16 and where thereby the mentioned radial balance of forces not exists. The arrangement of FIGS. 18 and 19 therefore employs an axially much wider thrust member 616,617, at least one of them, and the respective thrsust member includes fluid pressure balancing recesses 622, 623 axially of the control port 630 or 631. In case of application of two such thrust members, the fluid pressure from the opposite side of the control passage 628,629 into the respective fluid pressure balancing recess 622 or 623, whereof one is located axially of the respective port 630, 631 and the other in the opposite axial direction thereof. The axial direction is seen here along the central axis 614.

The fluid pressure balancing ports or pockets 622,623 serve together to balance the radial force of the opposite diametrically located respective control port 630 or 631 at least partially, but in actual application almost totally. The almost centrical floating of the control body in the rotor's central bore or rotor's hub is thereby assisted and in practical application in an effective extent also obtained. An absolut perfection of concentric floating is however seldom obtained, but attained only with an accuracy in the efficiency range of above ninety percent.

FIG. 19 also shows, that one-way check valves 620,621 should be provided to prevent back-flow from a high pressure space into a low-pressure passage 624 or 625. Respective moveable sealing arrangements 626,627, which may include a loading spring, should be provided to pass the flow into passage 628 and prevent an escape from said passage into the space 613 between the thrust members 616 and 617.

Naturally the thrust members 604,616,617 must be in communication with the main passages 605,606,624 or 625 of the control body in order to pass the flow of said passages to or from the respective control port 63, 631,608 or 609 and thereby to or from the respective working chambers 660,6 of the fluid flow facilitating device.

FIGS. 19 and 18 also show, that it is suitable and preferred, when space is available, to insert seals into respective axially extending outcuts 690 to prevent flow of leakage over the respective closing arch or control arch of the control body between high- and low-pressure ports on opposite sides of the control body. These seals 691 may therefore be called "control arch seals". They may be pressed by fluidpressure in pockets or recesses 690 into sealing engagement with the respective portion of the respective rotor's inner face 681.

The invention of the thrust members in FIGS. 16 to 19 may therefore also be defined as:

A device, wherein said control body is radially of said at least one space provided with an outcut, said at least one thrust body is provided with outer portions which fit between the walls of said outcut, and, wherein a small gap is formed in said outcut, communicated to said control port and sealed against leackage by a relative close fit between the outer face of the control body and the inner face of the respective rotor.

and; wherein said control body is provided with at least one recess in the control arch between the respective low-pressure and high-pressure control port of said control body and at least one control arch seal member is provided in said at least one recess and pressed with its outer face against said inner face of said rotor to seal against leakage from one of said control ports to the other of said control ports.

The arrangements of FIGS. 16 to 19 may also be described as:

A cylindrical control body for radial flow of fluid into working chambers of a fluid handling device which contains said control body in a hub of the rotor of the device, wherein a space extends through said control body normal to the axis of said controlbody and said space contains in said space along the axis of said space moveable thrust members which have outer faces in sliding engagement with the inner face of said rotor hub, pass fluid to and from said working chambers through passages in said thrust members, have a thrust chamber between said thrust members and hydrostatically balancing fluid pressure pockets in relatively opposite thrust members, and, wherein said thrust members are pressed against the face of the rotor hub for sliding engagement thereon by pressure in fluid in said thrust chamber, when said device operates under power.

And, as: The control body of above, wherein said rotors have have flow-through passages from said rotor hub to said chambers of a cross-sectional area less than the cross-sectional area of the respective chamber of said chambers to provide forces on the bottoms of said chambers in a direction toward said control body, wherein the axial extension of said thrust members is limited to a size to obtain and maintain a seal along said rotor in reaction and in relation to said forces on said bottoms of said chambers and in proper dimensioning respective to said cross-sectionally reduced rotor passages, and, wherein thereby said balancing recesses in said thrust members are spared and eliminated from said thrust members and said control body.

And, as: FIGS. 18 and 19 demonstrate by referential 610 the control body for radial flow, by referential 611 the rotor hub of rotor 612, by referential 613 the space which extends normal to the axis 614 of the control body 600 through control body 610 and which contains moveably along the axis 615 of space 613 the thrust members 616 and 617 with their outer faces 618,619 with which they seal along the inner face 611 of the rotor 612 of "12" of the summary of the invention. The thrust chamber 613 between the thrust members 616 and 617 is filled with high pressure fluid through one-way valves 621,622 and fluid is passed to the balancing pockets of "12" of the summary of the invention which are shown by referentials 622 and 623 out of respective channels 624,625 over moveable seals 626,627 and passages 628 and 629. The thrust members 616 and 617 also form the control ports 630 and 631. By their thrust against the face 611 of the rotor 612 a tightly sealed flow to and from chambers 6 is obtained without any disturbance of the control- or closing archs 632 and 633 of the control body 610. This embodiment can also be applied in single-stroke devices and not only in multiple stroke devices.

The invention of FIGS. 1 to 6 has herebefore been described in terms of terminology as they are presently used by the artisans in the field. For a better understanding of the invention in FIGS. 1 to 6 an understanding of the geometric mathematical appearances might enhance the work with the invention in practical application. It is therefore described in the following, what geometrical and mathematical matters are of importance in the invention. Accordingly in the following description of the invention, there will appear radii and axes as well as gaps and extensions. The gaps and extension faces will have inner and outer ends.

Looking at FIG. 2, the first axis will be the referential 59. The second axis will be the referential 58. The distance "d" between these axes is shown by the referential 611. The first radius is shown by referential 61 and the second radius is demonstrated by referential 62.

The inclined face portions of the previous description in terminology of the artisans will in the following description in geometric-mathematical terminology be called "extension faces 51". The outer faces 50,51 of the piston shoes 52 are thereby divided into slide faces 50 and extension faces 51. The piston shoe portions endwards of the slide faces 50 and of the separating recesses or unloading recesses 57 are hereafter called: "extensions".

The invention of FIGS. 1 to 6 then corresponds to the following definitions:

First definition:

An improvement on the outer slide faces 50 of piston shoes 52 in radial piston fluid flow facilitating devices, such as pumps, motors, compressors, transmissions, wherein said slide faces are the radial end faces of the piston shoes and are sliding along at least one respective guide face(s) 63 of the piston stroke actuator 163 of the device, while said guide face(s) 63 is (are) of cylindrical configuration of a first radius 61 around a first axis 59 and thereby an annular guide face 63, said outer faces 50 are at least partially substantially complementary configurated respective to portions of said annular guide face 63 and wherein said slide faces of said piston shoes are interrupted by recesses 55 which form fluid pressure pockets 55 which are filled with an interior fluid from fluid containing cylinders 100 through passages 54 to constitute with their surrounding sealing lands 56 hydrostatic bearing portions 55,56 as known in the art, and said improvement provides novelties, wherein said slide faces 50 form medial portions 55 which contain said hydrostatic bearings 55,56 and are substantially part-cylindrically with said first radius 61 around said first axis 59, wherein said slide faces 50 and piston shoes 52 have extensions 51 152, endwards of said medial portions in the direction of the movements of said piston shoes, wherein separating recesses 57 are provided between said sealing lands 56 of said hydrostatic bearings and said extensions 51, 152 and, wherein said extensions include extension face portions 51 of a second radius 62 around a second axis 58 which is parallely distanced from said first axis, whereby said extension face portions 51 with said second radius 62 are forming with portions of said annular guide face 63 gaps which have outer ends and inner ends with said inner ends near to said separating recesses 57 and said outer ends remote from said separating recesses 52 while said gaps are radially wider at said outer ends but narrower at said inner ends with the radial width gradually decreasing from said outer ends towards said inner ends whereby exterior fluid can enter into said gaps at their outer ends when said extensions 51 of said slide faces 50 of said piston shoes 52 are moving through exterior fluid substantially along said annullar guide face(s) 63 and the relative velocity between said extensions of said slide faces and said annular guide face draws said exterior fluid into said gaps while the viscosity in said fluid provides a resistance against escape of said fluid from said gaps whereby a pressure is built up in said gaps and said pressure increases with the nearness to said inner ends of said gaps and of said extension face portions 51 with said second radius 62, while said pressure in said gaps is utilized to provide a bearing action between said actuator's annular guide face portion 63 and said extension face portions 51 of said piston shoes 52.

2nd definition:

(21) The improvement of of the first definition, wherein said piston shoes 52 are pivotably borne on pistons 53 which are arranged and reciprocating in substantially radial cylinders 100 of rotors 101 of said fluid flow facilitating devices, where in said rotors 101 are revolvingly borne in a housing and form third axes 102 which are axes of rotation of said rotors 101, wherein said first axes 59 are parallel to said third axes 102 but distanced from said third axes by an eccentricity which is defined by the letter "e", wherein an axes containing imaginary medial plane 99 is provided through said actuator 163 and through the respective rotor 101 of said rotors, while said imaginary plane 99 contains said first and third axes 58,102, wherein said imaginary plane 99 defines the rotary angle zero of the axis of the respective piston 53 when one of said pistons locate with its axis in said imaginary plane, while every other pistons forms rotary angles of the value "alpha" between their respective piston axes and said medial plane, wherein said width of said gap between said guide face portions 63 and said extension face portions 51 are defined by the letter "W", wherein imaginary radial planes are imaginable and calculable from said second axis 58 through said gaps, wherein one of said imaginary radial planes of a respective gap of said gaps defines a zero plane extending from the respective second axis 58 of said second axis through the respective inner end of the respective gap of said gaps, wherein an angle defined by the letter "gamma" appears between said zero plane and another plane of said imaginary radial planes, wherein the respective second radius 62 of said second radius is defined by the letter "r" while the respective first radius of said first radius is defined by the letter "R", wherein the length of the respective extension face portion 51 of said extension face portions between said zero plane and said another plane of said imaginary radial planes is defined by the letter "L" and calculable by the equation $$L=2\ r\ pi\ gamma/360$$

with pi=3.14 and "gamma" in degrees, wherein said width "W" corresponds to the equation $$W=d\cos gamma+R-r-(d^2/2R)\sin^2 gamma,$$

wherein the respective imaginary radial plane through the respective outer end of the respective gap of said gaps defines the outer width of the respective gap and thereby the greatest width of the respective gap defined by the letters "Wg", wherein said greatest width "Wg" defines together with the relative speed between said extension face portion 51 and the respective portion of said annular guide face portions 63 and together with the axial breadth "B" of said extension face portion 51 the amount of inflow of fluid which is drawn into said gap, said axial breath "B", the viscosity of said exterior fluid and the respective different values of the local width "W" define the resistance to outflow of fluid from said gap, and, wherein said pressure in said gap is obtained from the equilibrium of said inflow and of said outflow of fluid into and out of said gap whereby said outflow is defined by said pressure, said viscosity, the respective local length and breadth of said length "L" and of said breadth "B" and the third power of the local width "W" of the respective local portions of the said respective gap.

Third definition:

The improvement of the first definition; wherein said inner end of said gap and thereby of said extension face portion 51 meets the cylindrical configuration which is defined by said first radius 61 around said first axis 59, whereby said inner end of said gap provides a width which is equal to the width of the clerance between the said slide face 50 of said medial portion 55,56 of said piston shoe 52 and said guide face portion 163 of said annular actuator guide face 63.

Fourth definition:

The improvement of the third definition, wherein an interposed portion 500 of a slide face 50 is provided between the respective separating recess 57 of said separating recesses 57 and the respective inner end of the respective gap of said gaps and the respective extension face 51,65,516 of said extension faces 51 on the respective piston shoe 52 of said piston shoes, whereby said interposed portion 500 of said slide face 50,51 forms an inner elongation of the respective extension face 51,65,516 with said first radius 61 and thereby with an inclination relatively to said extension face 51.65,615 of said second radius 62 in order to form an inner sealing land adjacent the said inner end of said respective extension face for the reduction of outflow of fluid from said gap of said gaps whereby a relative increase of the said pressure in said gap is provided and the bearing capacity of said gap between said respective extension face 51,65,516 and the said respective portion of said annular guide face 63 of said actuator ring 163 is increased.

Regarding the arrangement of FIGS. 1 to 6 it is also of interest, that the piston is reciprocably mounted in the cylinder 100 of a rotor 101 as generally known from the former art. The guide face(s) 63 is (are) the inner face(s) of the stroke actuator 163 as also generally known from the former art. For a better understanding of the portion of the invention, which is subjected to the development of the hydrodynamic pressure field over the inclined face portions 51, a zero plane and an outer plane may be drawn from the second axis 58 radially through the rotor and the respective piston shoe portion. The distance between the second radius 62="r" and the first radius 61="R" is defined as 611=distance "d". This is the distance between the radius 61 of the general outer face of the hydrostatically action outer face portion of the piston shoe 52 and the radius of the extension face portions 51,65,516. This first radius is drawn around the first axis 59. Different therefrom is the eccentricity "e" between the axis of the rotor 101 and the piston stroke actuator 163. The eccentricity "e" is the distance between the first axis 59 and the third axis 102, which is the axis of the piston stroke actuator 163.

In order to secure proper entering of lubrication fluid into the very narrow gap between the respective extension face portion, also called, "the inclined face portion" 51 and the respective portion of the guide face(s) 63 it is preferred to fill the housing of the respective device with an exterior fluid. This is called "exterior" fluid, because it is not in communication with the pressurized interior fluid in the cylinder 100, passage 54 and fluid pocket('s) 55. The mentioned exterior fluid is commonly not pressurized. But it will act over the face portions 51 as described, if it is properly drawn into the field over the mentioned face portions 51. In order to obtain a maximum of hydrodynamic bearing capacity over the face portions 51 of the invention, it is preferred to provide between the respective inclined face portion 51 and the adjacent separating recess 57 a short interposed portion 500 of a radius equal to the radius 61, the first radius, of the medial main portion with pocket 55 of the piston shoe 52. This interposed portion prevents escape of fluid from the hydrodynamic pressure field over the face portion(s) 51 into the separating recess(es) 57. Thereby it makes it possible to obtain a maximum of pressure and thereby of bearing capacity over the face portion(s) 51 in the respective hydrodynamic pressure field thereover. Those peripheral end portions of the piston shoes, which form the face portions 51 for the obtainment of the desired pressure and bearing field over face portion(s) 51 is shown in FIG. 2 by the referential number 152.

Figure 21:
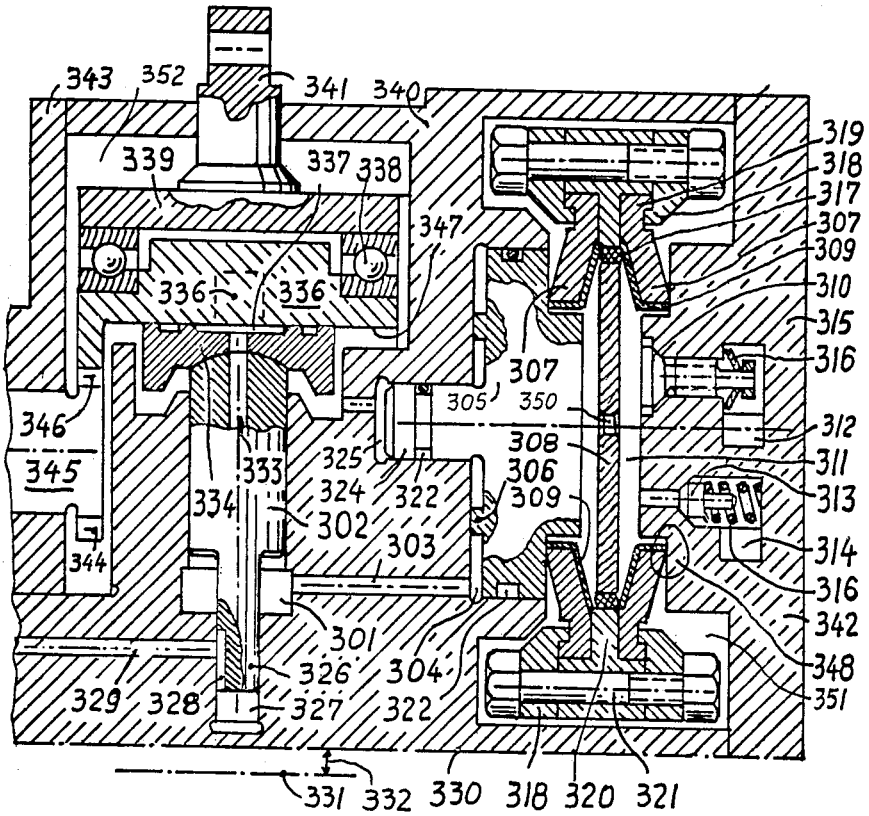
FIG. 21 is a longitudinal sectional view through a novel device of the invention, which employs united plural cylinders.

The novelties and features of the outer face of the piston shoe of FIGS. 1 to 6 may also be applied in the fluid facilitating device of FIG. 21.

FIG. 21 is a longitudinal sectional view through the upper portion above the center line of the device and thereby shows one radial half of the device in an example of the sectional view therethrough.

FIG. 21 thereby demonstrates one embodiment as an example of a combination cylinder arrangement of a fluid facilitating device of the invention.

Body or housing 340 is provided with at least one, but commonly with a plurality of first cylinder(s) 301, wherein the piston(s) 302 is (are) reciprocably located. Each piston 302 carries a piston shoe 334, which commonly is provided with the fluid pressure pocket 337 through its outer face and the pocket 337 is commonly supplied with interior pressure fluid from cylinder 301 through passage 333. The piston shoe and thereby the piston stroke is guided as known in the art along the respective inner face or guide face 347 of the piston stroke guide member 336. Stroke guide 336 may have a radial annular ring grove, shown by dotted line 336. The annular groove is then required, when the piston shoe and the rotor are of the system of my deep diving piston shoes of my older patents.

Body or housing 340 contains in accordance with this present invention also at least one, but commonly a plurality of a (some) second cylinder(s) 304 and one first cylinder 301 is alltimes communicated to the thereto belonging second clinder 304 by the internal passage 303. Passage 303 combines the first cylinder 301 and the second cylinder 304 of the invention to the system of the combined cylinders of the present invention. The respective second cylinder contains reciprocable therein, a respective second piston 350. Piston 350 may have an extension 324 into a guide cylinder 325 in order to prevent tilting of the bigger diameter portion 350 of piston 350 in its respective cylinder 304. Seal grooves 322 may be provided and seals may be inserted thereinto to obtain a close sealing of the piston 350 in cylinder 304 or 304 and 325. One top of the second piston 350 is a thrust means 307 provided, which may also serve further purposes and which will therefore obtain another name in the following of this patent application. Thrust means 307 tends to thrust piston 350 onto the bottom portion of cylinder 304 and it is important to provide a stopper on the piston 350 to clearly define the innermost location of the second piston in the second cylinder. In the Figure the stopper 306 defines such stopper on piston 350 and the piston 350 is drawn in this Figure in the innermost position, at which the stopper 306 is borne on the bottom face of the second cylinder 304.

Substantially at the outermost location of the first piston 302 in the first cylinder 301, fluid is led into the first cylinder 301, into the internal passage 303 and into the second cylinder 304 until the passage and the cylinders are completely filled with internal fluid. The filling is commonly done at low or medial pressure. The pressure at filling must be so small, that the thrust means 307 keeps the second piston 350 in touch with the bottom portion of the second cylinder 304. Because, if the second piston would be removed from its most inner location in the second cylinder, the desired action of the device of the invention would not function properly.

For the actual and automatic filling of the internal passage and of the cylinders as well for discharging overfilled fluid, it is preferred to provide an automatic filling and overflow system on the device of the invention. In the Figure such filling and overflow system is provided by the innermost piston extension 326 of the first piston 302. Extension 326 enters into the control cylinder 327 and reciprocates therein, when the irst piston reciprocates. A fluid supply channel 329 extends from a fluid supply source to the control cylinder 327. Piston-Extension 326 acts as a control means for the control of flow of fluid into and out of the combined cylinder system of the invention. For the mentioned control the control piston 326 is provided in this Figure with a control slot 328. Control slot 328 opens and communicates the supply channel 329 with the first cylinder 301 when the first piston 302 obtains its outermost postion in cylinder 301. How much before this outermost position or location of the first piston, the control slot opens the described communication, depends on the actual design of the device. During the major portion of the stroke of the first piston, the control arrangement, for example, of slot 328, closes cylinder 301 and prevents communication between the first cylinder 301 and the supply channel 329.

The body or housing 340 contains a second interior space 351 which borders onto the second piston 350, while the first interior space 352 borders the piston shoe 334 and the piston stroke actuator guide 336.

The second interior space 351 is subjected to inlet means 310 and oulet means 313, for example, inlet valve 310 and outlet valve 313. The consequence thereof is, that, when the second piston reciprocates, the volume of the second interior space increases and decreases periodically and thereby acts as a pump, which draws in fluid through inlet 310 and expells it through outlet 313.

After reading the above general description of the arrangement of this device, it will now be understood, how it works and functions. A drive means, for example 345,346 revolves the piston stroke guide 336, which has an eccentric axis 331 eccentric relatively to the central axis 330 of the main body 340, which contains the combined cylinders 301,304 of the invention. The eccentricity between the axes 330 and 331 is "e", namely 332. During the revolving of the guide 336, driven by the drive means, the first piston(s) 302 are reciprocated in the first cylinder(s) 301. The cylinders with the internal passage therebetween becomes filled with fluid or was filled with fluid. This fluid is commonly hydraulic fluid, for example, hydraulic oil, and it is called hereafter the "first fluid".

During reciprocation of the first pistons, the respective piston has a delivery stroke and an intake stroke. At the delivery stroke the first piston presses the first fluid through the internal passage 303 into the second cylinder 304 and thereby presses the second piston 305 into an outwards stroke. The second fluid in the second space 351 is thereby discharged through the outlet means 313, because the second space 351 reduces its volume, when the second piston 305 enters into it. At the following intake stroke of the first piston 302, the thrust means 307 presses the second piston 305 to an inwards stroke into the second cylinder 304. The first fluid in the second cylinder 304 is thereby passed through the internal passage 303 into the first cylinder 301 and fills it, following the outward stroke (intake-stroke) of the first piston 302. At the same time, the second space 351 in housing 340 increases its volume, because the respective top portion of the second cylinder 305 moves partially away from the second space 351. Consequently the inlet means 313 opens and new second fluid enters during the intake stroke of the first piston into the second space 351 in the housing 340. Thus, the first piston is driving the second piston and is operating a second pump, which is established in and on the second space in housing 340.

In other words, the first and second pistons reciprocate in unison in such way, that the directions of the strokes are reciprocal relatively to each other. At the same time the differences in diameter of the first and second pistons can define different lengths of the strokes of the first and second pistons 302 and 305. Thus, the arrangement of the device of this Figure 41 of the embodiment of FIG. 41 of the invention is a stroke transmission and can be a pressure- or rate of flow transmission, when the diameters of the first and second pistons 301 and 305 are different. The efficiency losses are to be considered, but they are not very significant, and are commonly in my devices only a few percent. Usually less than 20 percent over the entirety of the device.

The drive means in the figure is only by way of example. Commonly I am using a medial shaft with a cam ring with an eccentric outer face to drive piston 302, which is then arranged in the opposite direction. In the present FIG. 21 I have demonstrated however an adjustable piston stroke actuator. Connection portion 341 is provided on guide housing 339 and extends to the outside of hosuing 340 in the Figure. Thereby an exterior control source can become connected over portion 341 to guide housing 339. It can then radially adjust the guide housing 339 to a different location. Guide housing 330 carries in anti-friction bearings the rotary piston stroke guide ring 336. The bearings 338 are interposed between housing 339 and stroke ring 336. Drive shaft 345 is revolvably borne in the housing portion of housing 340 and it is driven to revolve by an outer power source. Shaft 345 may have a gear 344 to engage a gear 346 of the revolvable piston stroke actuator guide ring 336. In the Figure, the piston stroke actuator 336 which may with its outer portion revolve in bearings 338 around the centric axis 330, is provided with an eccentric radially inner outcut, which is bordered by the piston stroke guide face(s) 336. The guide face(s) 336 then revolves for example with the eccentricity "e"=332 and with the eccentric axis 331 around the centric axis 330. Thereby the inner face 347 of piston stroke actuator 336 becomes the piston stroke guide face(s)347 and guides the piston stroke of the respective first piston 302. For radially adjustable locations of guide housing 339, the gears 344,346 are respectively configurated to permit a radial displacement of the distances between them.

In the Figure the entire system is shown stationary, which means, that the first and second cylinders are provided in stationary portions, for example, in the housing 340. But instead it is also possible, to provide the piston(s) in a rotor or in a rotary or moving body. That is commonly done in many of my older patents on pumps and motors. If however, the present invention would be applied in a rotor within the gist of the present invention, such rotor or some of such rotors would have to contain at least one first piston in a first cylinder, at least one second piston in the second cylinder and the internal passage therebetween. The fluid is then passed through respective control bodies, which are also known from my elder patents, from stationary bodies to the rotary body(ies) and vice versa. The provision of the invention in at least one rotary body is not illustrated, because the functioning and building of it is understood athand of the FIG. 21. Because what the invention concerns, is the provision of the first and second pistons and cylinders or chambers and the internal passage therebetween.

As far as the device of FIG. 21 is described until now, it is very suitable for lubricating fluid. If however the second fluid is a corroding fluid, which corrodes the materials of housing 340 and of the second piston 305 or of the thrust means 307, a different solution is preferred. Because the members of the device, specifically the clearance between the wall of the second cylinder and of the second piston would get corrosion and might thereby be disturbed or even stick. Such non-lubricating and corrosion-active fluid is for example, the water.

It is therefore a further aim of the invention, to provide a second stage of pumping for a corrosion providing fluid. This aim also includes to provide such second pump or third pump for very high pressure of a non-lubricating, but corroding, third fluid.

In this case the second piston becomes a motor to drive the pumping arrangement of the third pump. For example, if the interior second housing space 351 is provided with inlet and outlet means, and the hereafter to be discussed third pump is also provided with inlet and outlet means, then the second interior space 351 forms the second pump with the outer end portion of the second piston 305 beeing the pumping piston therein and the hereafter to be discussed third pump space 311 becomes with its inlet and outlet means 310,313 the third pump.

In FIG. 21 the inlet means and outlet means were discussed heretofore so, as if the third pump chamber 311 would not have been provided. The inlet and outlet means 310 and 313 would then have been in communication directly with the second interior space 351.

When now looking deeper into the details, it will be seen however, that in 21 the inlet valve and outlet valve 310 and 313 are communicating not to the second interior space, but to the third pump-chamber 311. That shows, that it is possible by suitable election to either use the second space 351 as a second pump or not to use it as a second pump. When not used as a second pump, then the inlet and outlet means 310 and 313 are not communicated to the second interior space. Since in such case the second interior space 351 would periodically increase and decrease its volume at reciprocation of the second piston 305, it is then suitable to provide the second interior space with a communication passage to a space under no or low pressure. Such passage is visible without a referential number on the left end of cylinder portion 325 in FIG. 21 and this passage there also serves to prevent compression and expansion in the cylinder portion 325.

Attention is now given to the third pump in FIG. 21, which is the pump for the non-lubricating and corrosion providing third fluid. Since corrosive fluid disturbes the clearances between corrosion-liable materials like steel, iron and the like, the third pump is in my invention a pump with no sealing parts under movement relatively in a close clearance to a neighboring face.

Therefore, the third pump is provided with at least one tapered pump element 307. In the Figure there are two tapered elements 307, which are opposing each other with the hollow cones. The at least one tapered element has an inner end face axially on it's radially inner portion and an outer end face on its axially inner end on it's radial outer portion. The radial outer portion of the tapered element is clamped onto an adjacent part of the pump. For example, to the outer end of the second piston 305, to the housing interior face portion of housing 340 or end cover 342—(343 is the front cover of housing 340)—or to the opposed second tapered element 307. In FIG. 21 there are two tapered elements 307, open towards each other with their hollow cones to form therebetween the third pump chamber 311. A medial outer ring 320 is inserted between the radial outer portions of the elements 307. The clamping arrangement consists of clamp portions 318, which may be angularily cut into separated clamps, which embrace the radial outer ends of the tapered elements 307 and the medial outer ring 320. Respective fingers of the clamps may engage into grooves or recesses in the radial outer end portions of the tapered elements 307 to prevent escape of the clamping means 318 from the tapered elements 307. Holders, for example, bolts with nuts, keep the clamps 318 fastened strongly together. A seal ring, for example, an O-ring 317 is inserted between the tapered elements and the outer ring, 320, to seal the interior third pumping chamber 311 radially against the medial outer ring 320. Seal sheets 309 are set innermost around or along the tapered elements 307 to prevent the corrosion providing third fluid from meeting the walls of the tapered elements 307. The O-ring 317 also seals along these seal sheets or protection sheets 309. A medial inner ring 308 is inserted between the two tapered elements 307, holds the O-ring 317 in its place, is provided with a passage 350 to communicate the both chamber portions of chamber 311 on both ends of the medial inner ring 308 with each other and also serves as a dead space filler to reduce internal compression losses in the third fluid at very high pumping pressure. The entrance and exit valves 310 and 313 are communicated to the third pumping chamber 311 and serve as inlet and outlet means for the third fluid. The operation of the device of FIG. 21 is now as follows:

The first piston is driven by the drive means, for example 345 and the guide face 347. The first piston drives with the first fluid through the intermediate or internal passage 303 the second piston 305 in the second cylinder 304. The head of the second piston 305 bears the inner end of the left tapered element 307 and compresses it. Since the third pumping space 311 is completely sealed, has no moving relative close faces, and since all parts bordering the third space are protected from meeting the third, corrosion providing fluid, the second piston 305, compresses the tapered pumping elements 307, presses the third fluid out of the third pumping chamber 311 through the outlet valve 313, while it at the same time closes the inlet valve 310.

When thereafter the first piston 302 reverses the direction of its stroke, the tapered elements 307 act under their compression stress as springs and drive the second piston 305 inwards in the second cylinder 304. The first fluid from cylinder 304 passes through passage 303 into the first cylinder 301 and the inlet means 310 opens and draws the new third fluid into the now expanding third pumping chamber 311.

So far the device is easily to be understood and its operation looks rather simple. In practice however, for the very high pressures in the third fluid, which my device is able to manage, quite a substantial "know-how" is required. Some of such "know-how" is explained at the description of the following Figures.

My device is commonly driven by my hydraulic motors, which means, that my hydraulic motor drives the driving shaft 345. The motor is then a complete unit together with the device of FIG. 21. In other applications the drive means is driven by combustion engines or electric motors. Until now my device has been operated with water as the third fluid and with pressures of onethousand atmospheres, corresponding to roughly fifteenthousand pounds per square inch. It is however my intention to increase the pressure of the third pump chamber 311 considerably higher for example, close to fiftythousand pounds per square inch. The efficiency at 1000 atmospheres was quite good.

A first "know-how" for example, is, that common disc springs, which are also known as "Belleville springs" are not suitable for use as tapered elements in my pump. They break already after 40,000 strokes. But in my device the lifetime of the tapered pumping elements shall be about several tenmillion strokes, amounting to thousnandth of hours of life time under highest pressure in the corrosion-active third fluid.

I obtain this aim by using tapered elements with relatively big inner diameter but with rather small radial extension relatively to the mentioned inner diameter. That reduces the stresses in the tapered pumping elements 307. Further important, for good efficiency of the device unavoidable is the setting of the clamping means 307 and the subjection of the tapered elements to short strokes of deflection of the tapered elements 307. It is therefore important under the "know-how" to use big differences of diameters of the first and second pistons 302 und 305 of the device. Further "know-how" will be explained at the description of the following Figures.

Figure 22:
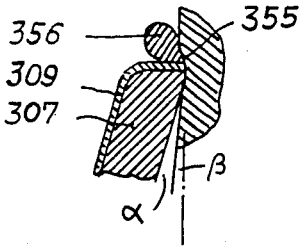
FIG. 22 is an enlargement of a portion of FIG. 21.

FIG. 22 shows an enlargement of portion 348 of the device of FIG. 21. The tapered element 307 changes its angle relatively to the cover's inner face from angle alpha to beta during the compression. That would lift the edge of the inner end of the tapered element away from the cover face of cover 342. The seal ring 356 would then enter into the opening gap and disturb itself. The seal would be disturbed and the pump would not work any more. It is therefore suitable to form the inner seat face of the cover 342 with a small dell of suitable configuration and angle, wherealong the inner edge of the tapered element 307 can slide at compression and expansion without departing too much from the support face. Thereby the entering of seal ring 356 into a gap is prevented, because the appearance of the gap is either prevented or reduced in such an extent, that the respective portion of the seal ring 356 can not any more enter into a gap and thereby can not disturb iteslef.

For plural third pumping chambers 311, a common inlet space 312 may be provided to the inlet valves 310 and a common pressure fluid collection chamber 314 may be provided to the exit valves or delivery valves 313.

Another important "know-how" is, that in my tapered elements 307 the internal stresses due to compression of the tapered ring element, as generally known from Almen and Laszclo for Belleville springs, are minor compared to the more sudden appearing stresses under fluid pressure from the bottom of the respective elements 307. The stresses are called in FIG. 23 "sigma Bi" for the stress found from the inner moment and "sigma Bo" for those found from the outer moment of the radial outer portion of the element.

In FIG. 23 the tapered element portion of element 317 is kept between the holders "H" and the fluid pressure "q" is acting from the bottom in axial direction against the element. The element then bows upwards out under such fluid pressure, as the Figure demonstrates. Thereby the inner stresses "sigma" occur in the element. FIG. 23 also demonstrates, how I derived the calculation formulas. The outer moments which are occuring under the fluid pressure along the radial distances "delta R" are cited by: "Md". But the inner moments inside of the elements 307 are cited by: "M", whereby "M" is the distance "delta R" divided by the half of the thickness "S" of the element. The figure shows portions "dR" on radius "R" to find the differential and integral calculus. "I" is the moment of inertia of the element-portion between the radial angle "phi". "B" would be the width, if the portion of the element would not be a portion of a ring in bounderies of the angle "phi". The width would then be a constant. Note please, that the integration is not starting from the axis of the element, but the uncommon integration, which I do, starts from the inner diameter of the element, while the moment of inertia and the width of the element between the bonderies of angle "phi" go into the integration from the center axis of the element.

The radius, at which the moments from the inner delta radius portion and the outer radius portion "delta Ri" and "delta Ro" are giving equal moments "Md" is called by me: "Rcm". The radius, where the said outer moments give equal moments around the holders "H" is called by me: "Rcmh".

The radius, which gives equal inner stresses because of inner moments "M" inside of the element, is called by me: "RCM"; while the radius which would give equal inner moments and stresses around the holders "H" is called by me: "RMCH". These radii are found by graph, whereupon a final respective value is then repeated by the exact calculation with the respective nearly final value, until the exact values are found.

It is important here, to understand, that these values are different from the arithmetic mean of "R" and "r", when "R" is the outer and "r" is the inner radius of the tapered element 307. The medial radius of the gravity center "Rgc" of my control body patents is also different from the above values, because it considers the ares of the section, but not the moments of it.

The different location of the mentioned radii (medial radii) for the respective purposes are for demonstration of their location substantially shown in FIG. 24. Actually they are closer together, than in FIG. 24. But they can not be drawn closer in the Figure, because the lines of the ink would be too big compared to the small radial distances. Of interest is also, that the recess(es) or groove(es) for the clamp 318 does (do) not disturb the life time of my tapered pump element 307, because the groove is placed there, where the inner stress in the element is small.

FIG. 24 shows in a schematic demonstration the principial locations of the novel radii Rmc, RMC, Rmch and RMCH in comparison to the arithmetic medial value Rm and to the radius Rgc of my older patents, which corresponds to the radius of the centroid of an element of the pumping element 307. The respective equations, which I have derived, are written also in FIG. 24.

FIG. 25 demonstrates in a schematic the different stresses inside of the pumping element 307 over the rotary angle alpha, wen the drive means of FIG. 21 or an eccentric outer face of a cam is used to drive the device of FIG. 21 and when a radial difference appearing from pivotal movement of a piston shoe is neglected as neglectible small. Curve 361 shows the highest internal stress in the pumping element 307 which is due to mechanic compression of the element by the second piston. It is seen here, that this curve is rather smooth and has no stiff rises of the stresses. Curve-line 362–363 however shows the stresses, maximum thereof, which are due to the fluid pressure in the third pumping chamber 311. It is visible from the left curve 362, that this stress is appearing much more suddenly, than the stress which is due to the mechanical compression of the element 307 by the second piston 305. Once the maximum of stress 362 is reached, the stress remains constant along line 363, because the delivery pressure of pumping chamber 311 is now constant. The sudden increase in stress along curve 362 shows, that this stress damages the life time of the pumping element 307 more, than the more slowly appearing stress of curve 361.

The actual delivery quantity of the first pump, the second motor and the third pump is parallel to curve 361 of FIG. 25 over the rotary angle alpha of the piston stroke drive and guide means.

Figure 20:
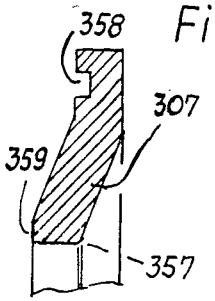
FIG. 20 is a sectional view through a pumping element.

FIG. 20 shows a portion of the element 307 of FIG. 21 in sectional view in a separated demonstration to indicate, that the groove 358 for the reception of the respective portions of the clamping arrangement 318 can be cut until one third of the thickness of the element 307, because this place is a place of small internal stress in the element 307. The inner corner 357 should be rounded in order to soften the internal stresses here. Good care must be taken for the inner axial outer end 359. This should never be a line as in common Belleville springs, because a line would bring too big stresses. It should be flattened substantially to a plane face, but better to a specific configuration in line with the dell 355 of FIG. 22.

The device of FIGS. 7 to 10 may also be defined as follows:

(24) An arrangement in a fluid flow facilitating device of the axial piston type, wherein substantially axially extended pistons reciprocate in substantially axial cylinders 34 of a barrel 35;

wherein a first primary control means 3,37 is provided to control the flow of fluid to and from said cylinders, wherein said arrangement provides a second control means 1 for the passage of a control flow, and, wherein said control flow 1 extends through said first primary control means 3,37 and through a first passage 1, which extends through said barrel 35 into a second passage 5,49, which extends into a shaft 38 of said arrangement.

(25) The arrangement of the above;

wherein said arrangement is provided in an axial piston fluid facilitating device which includes two shafts 2,38, which revolve in unison and constitute a first shaft 38 with a first axis 401 and a second shaft 2 with a second axis 402, wherein said shafts and axes are inclined under an angle relative to each other, wherein the rear end of said first shaft forms a hollow reception bed of the configuration of a part-ball with a first radius 405 around a first point 406 of said first axis, wherein said second shaft forms on its front end a head 4 of a configuration of a part of a ball with a second radius around a second point 406 of said second axis, while said first and second points coincide, wherein said head is borne in said reception bed and able to swing therein when said shafts revolve, and, wherein said reception bed has in its medial portion an outcut 5,48 on the rear end of said first passage and said outcut has a suitable diameter to remain in connection with said second passage at the highest possible angle of inclination of said axes relative to each other, whereby said first and second passages are communicate with each other through said outcut at all times during revolution of said shafts.

Figure 26:
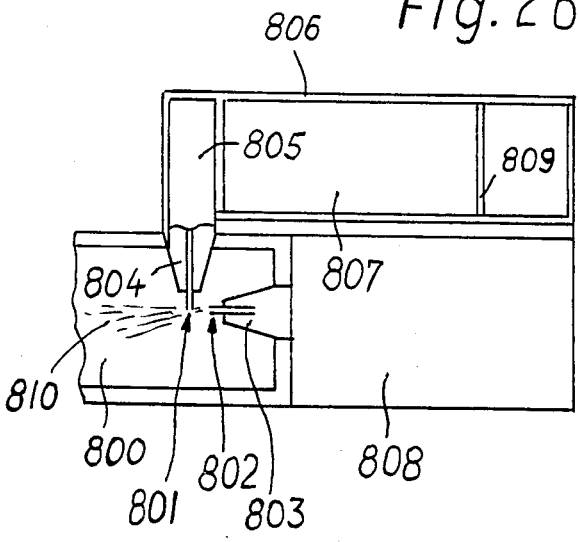
FIG. 26 is a schematic of a coal fuel injection system of my invention.

FIG. 26 demonstrates in a schematic a novel fuel injection system for a combustion engine of my invention. It is best applied to any pressed and cleaned coal combustion engine of my co-pending patent application Ser. No. 529,254 or to others of my co-pending patent applications. Instead of pressing the cleaned coal to blocks, in this embodiment of the invention, I compress them to wires or flat long bands of small thickness and inject and pulerise the fuel of coal by leading a high pressure liquid jet against the inwards moving fuel wire or tape. This immediately pulverises the coal to a coal-liquid stream, at which the liquid also may be water. The water immediately steams in the hot common combustion chamber and the fuel immediately burns therein to provide the hot-air-gas for the expansion stroke of the piston of the engine.

Thus, FIG. 26 demonstrates a fuel container 806 indluding a pretransporter 809 for transporting the pressed coal tape, wire, band, 807 towards the second transporter 805 which transports the coal fuel wire, tape, band, in a continuous flow through an inlet guide 804 into a combustion-chamber 800, while a high pressure fluid, liquid, pump 808 is provided and attached to the arrangement of the fuel supply and the combustion chamber, and the said fluid pump supplies through a second inlet, nozzle, 803, a steady flow of high pressure fluid in the form of a speedy and strong pressurized jet 802, which is directed against the inflowing coal fuel stream 801 of said inlet guide 804, whereby said jet of liquid meets said inflowing coal fuel stream to pulverize it and spray it as a fine powder, 810, partially mixed with said fluid into said combustion chamber to provide a continuous and steady flow of burnable coal-fuel-fluid-mixture 810 for burning in the compressed air in said combustion chamber of said combustion angine at least as long as said combustion chamber is pressurized with hot air and ready to supply and lead the burning or burned pressed air-coal fuel-fluid mixture into the respective expansion chamber with the respective expansion piston of said engine.

When the said liquid is water, it might vaporize to steam and transform to overheated steam inside of said combustion chamber for participation in the expansion and driving procedure with said hot air-fuel mixture in said expansion chamber of said engine.

My high-pressure fluid flow arrangement of FIG. 21 has the high pressure capality to be used as fluid pump 808 in the arrangement of FIG. 26. It may also be used to jet coal sludge or other difficult handling fuels into the combustion chamber 800 of FIG. 26; or to be used as fuel injection pump in conventional combustion engines.

Figure 7A:
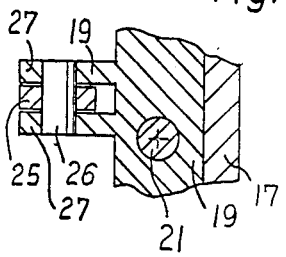
FIG. 7A is a cross sectional view through FIG. 7 along the arrowed line VIIA—VIIA of FIG. 7.
Figure 7B:
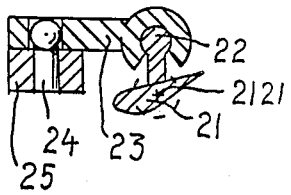
FIG. 7B is a cross sectional view through FIG. 7 along the arrowed line VIIB—VIIB of FIG. 7.
Figure 7C:
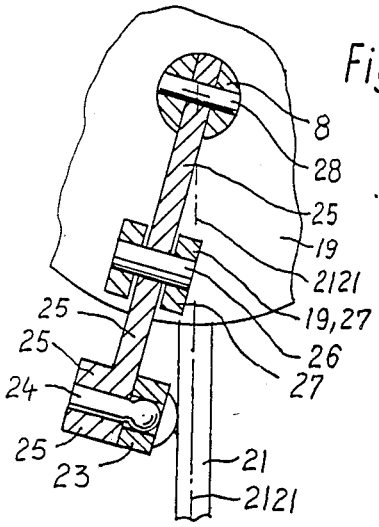
FIG. 7C is a cross sectional view through FIG. 7 along the arrowed line VIIC—VIIC of FIG. 7

Referring now again to FIG. 7; it may be noted, that the control piston 8 is suitably arranged to move a movable member, for example, member 21, especially if such movable member is at least indirectly born on the driven shaft 30. In the Figure the driven shaft 30 carries a flange 17 with a body 19 which bears pivotably in a radial space in body 19 the root 2121 of a pivotable member 21. Member 21 may be a propeller blade. The axial movement of the control piston 8 is transferred by a transmission means which includes a lever 25, borne in a holder 27, and connected to the control piston 8 and the movable member 21. The linkage between the control piston 8 and the member 21 is best understood by reading FIG. 7 together with its cross sectional FIGS. 7A, 7B and 7C. FIG. 7A is a cross sectional view through FIG. 7 along the arrowed line VIIA—VIIA; FIG. 7B is a cross sectional view through FIG. 7 along the arrowed line VIIB—VIIB and FIG. 7C is a cross sectional view through FIG. 7 along the arrowed line VIIC—VIIC of FIG. 7.

From the comparison of these Figures it will be seen in FIG. 7A that the holder 19 which bears the lever 25 by pin 26 in its swing center, that the holder 27 is laterally offset from the axis of the root of the movable member 21. The result thereof is that the outer end of lever 25 is laterally provided respective to the pivot lever 22 of the movable member or propeller blade 21. See hereto sectional FIG. 7B. That a lateral offsetting is provided is also seen in sectional FIG. 7C. The inner end of lever 25 is connected by pin 28 to the outer end of the axially movable control piston 8. The outer end of lever 25 is connected to lever 23. Lever 23 is with its ends connected to levers 25 and 22, respectively. In order to make a proper operation of the connections possible it is preferred to provide part spherical heads on pin 24 and lever 22. The referential numbers which are shown in FIGS. 7A,7B and 7C are, otherwise, known from FIG. 7.

I claim:

1. An arrangement in a fluid flow facilitating device of the axial piston type, wherein substantially axially extended pistons reciprocate in substantially axial cylinders of a barrell, wherein a first primary control means is provided to control the flow of driving fluid to and from said cylinders, wherein said arrangement provides a second control means for the passage of a separate control flow, wherein said control flow extends through said first primary control means and through a first passage which extends through said barrell into a second passage which extends into a shaft of said arrangement, and, wherein an axially directed chamber is provided in said shaft to communicate with said control flow and which contains a control piston whereby said control piston which reciprocates in response to said control flow to drive a reciprocable portion of a member which is provided at least indirectly on said shaft.

2. The arrangement of claim 1, wherein said arrangement is provided in an axial piston fluid facilitating device which includes two shafts which revolve in unison and constitute a first shaft with a first axis and a second shaft with a second axis, wherein said shafts and axes are inclined under an angle relatively to each other, wherein the rear end of said first shaft forms a hollow reception bed of the configuration of a part-ball with a first radius around a first point of said first axis, wherein said second shaft forms on its front end a head of a configuration of a part of a ball with a second radius around a second point in said second axis, wherein said head is borne in said reception bed and able to swing therein when said shafts revolve, and, wherein said reception bed has in its medial portion an outcut on the rear end of said first passage and said outcut has a suitable diameter to remain in connection with said second passage at the highest possible angle of inclination of said axes relatively to each other, whereby said first and second passages are communicated with each other through said outcut at all times during revolution of said shafts.

3. An arrangement in a fluid flow facilitating device with provision of a commonly applied primary first control means and at least one rotor, wherein the arrangement provides a second control means for the control of a controllable matter associated to the device, provided on a holding face of an axial piston type fluid flow facilitating device, such as a pump, motor or transmission of the axial piston type, wherein said holding face is commonly utilized to hold the spherical head of a shaft of the device, wherein the arrangement consists of a passage through said holding face in combination with a passage extension into a cylinder arranged in said shaft of said device, wherein an axially movable piston which is biased at one end by a spring force and is biased at the other end by fluid pressure passed through said passage through said holding face into said cylinder, wherein said piston includes transfer means to transfer its movement to controllable members, and, wherein thereby said controllable members are controlled by said fluid pressure which passes through said arrangement of said passage through said holding face.

4. The arrangement of claim 3, wherein said primary first control means is a control face arrangement of a stationary control face provided on a stationary portion and a thereto parallel and thereon sealingly sliding rotary face on a rotor of said axial piston type device, said passage of said holding face is said second control means of said arrangement; and wherein said holding face is provided in the shaft of the device and holds the head of a medial portion of said rotor, and, wherein said passage extends through said medial portion, said rotor and said control face arrangement sealed against loss of pressure and fluid into and through a stationary portion of the housing of said axial piston device to form a control port for the reception of control fluid for the control of said controllable members.

5. The arrangement of claim 1, wherein a first communication passes fluid to a respective fluid pressure pocket of a hydrostatic bearing adjacent to said holding face, said passage and said communication extend through said rotor and said medial portion towards said holding face, said holding face seals said fluid pressure pocket and separates the fluids which are passed through said passage and said communication from each other and, wherein a recess is provided in said head of said medial portion to communicate with said passage.

6. A fluid motor of the axial piston type, comprising, in combination, (a) pistons which reciprocate in axially directed cylinders of a rotor which is revolvably borne on a medial shaft in the rear portion of a housing with said medial shaft forming on its front end a part ball formed holding head;

(b) a driven shaft provided under an angle of inclination relative to said rotor and to said medial shaft while said driven shaft is revolvably borne in the front portion of said housing;

(c) ports, passages and control faces to pass a flow of pressurized driving fluid through said cylinders to drive said pistons for power strokes in said cylinders;

(d) a piston rod holding flange provided on the rear end of said driven shaft to hold the front heads of piston rods which with their rear feet are swingably borne in said pistons while a holding bed is provided in the medial portion of the rear end of said driven shaft to bear therein a holding head of the front portion of said medial shaft whereby said medial shaft which with its rear end is borne in the rear end of said housing obtains the holding of its front end and of its rear end;

wherein said medial shaft is provided with a passage which extends axially through said medial shaft to provide a fluid line for a control flow of pressurizable fluid of a control flow pressure;

wherein said driven shaft is provided with a chamber which is communicated to said holding bed while a communication is provided between said chamber of said driven shaft and said passage of said medial shaft;

wherein a control piston is axially movably provided in said chamber of said driven shaft;

wherein a control flow port is provided on the rear end of said passage of said medial shaft to permit the supply of said control flow of pressurized fluid into said passage of said medial shaft, whereby the rear end of said control piston in said chamber in said driven shaft is subjectable to said control flow pressure of said control flow of pressurizable fluid and said control piston is connectable to a movable member which is at least indirectly partially borne by said driven shaft to move said movable member in dependance on the axial movement of said control piston.

7. The motor of claim 6, wherein said control piston is reciprocable in said chamber and the front end of said control piston is subjected to a force opposed to said pressure of said control flow on said rear end of said control piston, whereby said control piston is reciprocated in said chamber under the relative variation of said force and said pressure of said control flow.

8. The motor of claim 6;

wherein said chamber is axially extended in said driven shaft to permit an axially directed reciprocation of said control piston in said chamber in said driven shaft, and, wherein said control piston is subjected to the force of a spring means in a direction opposed to said pressure of said control flow on said rear end of said control piston, whereby said pressure of said control flow defines the axial movement and location of said control piston in said chamber.

9. The motor of claim 8, wherein said driven shaft carries a flange with therein provided movable members and transmission means extended from said control piston to said movable members to move said members in response to said pressure in said control flow.

10. The motor of claim 9, wherein said members are roots of propeller blades which are pivotably borne in said flange, and, wherein said transmission means include means to transform said reciprocation of said control piston into pivotal movement of said propeller blades, whereby said propeller blades are pivoted in response to said pressure of said control flow.

11. The motor of claim 6, wherein said angle of inclination between said medial shaft and said driven shaft exceeds thirty degrees, wherein an annular groove is provided in said head of said medial shaft to meet said communication when said driven shaft revolves, and, wherein said passage through said medial shaft communicates with said annular groove.

12. The motor of claim 11, wherein said inclination between the axes of said medial shaft and said driven shaft is forty five degrees and said passage of said medial shaft branches into a pair of passages which are inclined relative to each other under an angle of ninety degrees, while the roots of said passages are slightly forwardly distanced from the center of said head of said medial shaft by a first distance, wherein said communication is provided with a cylindrical port of a radius which is substantially equal to seventy one percent of said first distance, whereby said annular groove is and remains closed by the face of said holding bed but a portion of said annular groove remains open towards said communication when said driven shaft revolves, while said first distance and said radius define an area of axial projection radially inwards of said annular groove at which area the outer face portion of said head is borne by the inner face of said holding bed, whereby said area provides a capability to carry a load of one of said shafts under fourty five degrees on the other of said shafts.

13. The motor of claim 11, wherein said annular groove surrounds a portion of the outer face of said head of said medial shaft, wherein said portion of said outer face constitutes a spherical bearing with its axial projection defining a cylindrical bearing symmetrically around the axis of said medial shaft, wherein said spherical bearing face bears and slides at least partially on a respective portion of said holding bed to meet the respective holding bed face portion of said holding bed, wherein fluid pressure recesses are provided in said circular bearing face while said recesses are communicated to a second passage through said medial shaft; and;

wherein said recesses are closed by said holding bed face portion.

* * * * *